US011328855B2

(12) United States Patent
Ashizawa et al.

(10) Patent No.: US 11,328,855 B2
(45) Date of Patent: May 10, 2022

(54) COIL COMPONENT AND MANUFACTURING METHOD THEREOF

(71) Applicant: TDK Corporation, Tokyo (JP)

(72) Inventors: Syun Ashizawa, Tokyo (JP); Satoshi Sugimoto, Tokyo (JP); Takahiro Banzai, Tokyo (JP); Hitoshi Sasaki, Tokyo (JP)

(73) Assignee: TDK CORPORATION, Tokyo (JP)

( * ) Notice: Subject to any disclaimer, the term of this patent is extended or adjusted under 35 U.S.C. 154(b) by 450 days.

(21) Appl. No.: 16/253,044

(22) Filed: Jan. 21, 2019

(65) Prior Publication Data

US 2019/0237245 A1 Aug. 1, 2019

(30) Foreign Application Priority Data

Jan. 30, 2018 (JP) ..... JP2018-013479
Apr. 13, 2018 (JP) ..... JP2018-077309

(51) Int. Cl.

| | |
|---|---|
| ***H01F 27/29*** | (2006.01) |
| ***H01F 27/28*** | (2006.01) |
| ***H01F 27/24*** | (2006.01) |
| ***H01F 41/12*** | (2006.01) |
| ***H01F 27/32*** | (2006.01) |

(52) U.S. Cl.

CPC ..... *H01F 27/2852* (2013.01); *H01F 27/24* (2013.01); *H01F 27/29* (2013.01); *H01F 27/324* (2013.01); *H01F 41/125* (2013.01)

(58) Field of Classification Search

CPC .... H01F 27/2852; H01F 27/24; H01F 41/125; H01F 27/324; H01F 27/29; H01F 17/04; H01F 27/306; H01F 27/292; H01F 27/255; H01F 27/2847

See application file for complete search history.

(56) References Cited

U.S. PATENT DOCUMENTS

| | | | | |
|---|---|---|---|---|
| 7,525,406 | B1 * | 4/2009 | Cheng | H01F 17/043 336/232 |
| 2006/0145800 | A1 * | 7/2006 | Dadafshar | H01F 27/2847 336/82 |
| 2007/0252669 | A1 * | 11/2007 | Hansen | H01F 27/255 336/212 |
| 2008/0074225 | A1 * | 3/2008 | Hansen | H01F 41/02 336/83 |

(Continued)

FOREIGN PATENT DOCUMENTS

| | | | |
|---|---|---|---|
| JP | 05-013241 | A | 1/1993 |
| JP | 2951324 | B1 | 9/1999 |

(Continued)

*Primary Examiner* — Mang Tin Bik Lian
(74) *Attorney, Agent, or Firm* — Young Law Firm, P.C.

(57) ABSTRACT

Disclosed herein is a coil component that includes a conductor plate; and a magnetic core comprising a magnetic material having conductivity, the magnetic core having a through hole into which the conductor plate is inserted. The conductor plate includes: a metal element body having a body part positioned inside the through hole and a terminal part positioned outside the through hole; a metal film formed on the terminal part, the metal film comprising a metal material having a lower melting point than the metal element body; and an insulating film formed on a surface of the body part without the metal film interposed.

9 Claims, 24 Drawing Sheets

(56) References Cited

U.S. PATENT DOCUMENTS

| | | | | |
|---|---|---|---|---|
| 2008/0231406 | A1* | 9/2008 | Lin | H01F 27/292 336/200 |
| 2008/0303624 | A1* | 12/2008 | Yamada | H01F 3/14 336/212 |
| 2010/0176909 | A1* | 7/2010 | Yasuda | H01F 3/12 336/233 |
| 2010/0237973 | A1* | 9/2010 | Cheng | H01F 41/04 336/83 |
| 2013/0154780 | A1 | 6/2013 | Yamada et al. | |
| 2014/0266552 | A1* | 9/2014 | Silva | H01F 27/306 336/207 |
| 2014/0292459 | A1* | 10/2014 | Andres | H01F 38/28 336/105 |
| 2015/0332844 | A1* | 11/2015 | Xiong | H01F 27/24 323/271 |
| 2016/0005528 | A1* | 1/2016 | Yan | H01F 27/292 336/192 |

FOREIGN PATENT DOCUMENTS

| | | | |
|---|---|---|---|
| JP | 2000306751 | A | 11/2000 |
| JP | 2004221177 | A | 8/2004 |
| JP | 2005310812 | A | 11/2005 |
| JP | 2009016797 | A | 1/2009 |
| JP | 2013125896 | A | 6/2013 |

* cited by examiner

COIL COMPONENT AND MANUFACTURING METHOD THEREOF

BACKGROUND OF THE INVENTION

Field of the Invention

The present invention relates to a coil component and a manufacturing method thereof and, more particularly, to a coil component having a configuration in which a conductor plate is inserted into a through hole formed in a magnetic core and a manufacturing method thereof.

Description of Related Art

A coil component for power supply use is sometimes provided with a conductor plate made of metal such as Cu (copper) since a comparatively large current flows therein during actual use. For example, a coil component described in JP 2000-306751 A includes a magnetic core having a through hole and made of NiZn-based ferrite and a conductor plate inserted into the through hole. As described in JP 2000-306751 A, the NiZn-based magnetic core has high insulation, so that there is no need to form an insulating film on the surface of the conductor plate.

However, the NiZn-based ferrite is comparatively low in permeability, so that it is preferable to form the magnetic core by using a magnetic material having conductivity like a MnZn-based material in order to achieve higher magnetic characteristics. When a magnetic material having conductivity is used as the material for the magnetic core, the conductor plate and magnetic core need to be electrically insulated, so that as described in Japanese Patent No. 2,951,324, an insulating film needs to be formed at a part of the conductor surface that contacts the magnetic core.

On the other hand, in order to ensure solder wettability at mounting, a metal film, such as a tin-plated film, made of metal having a low melting point needs to be formed on the surface of the conductor plate. However, when a metal film having a low melting point is interposed between a metal element body and an insulating film, the metal film existing between the metal element body and the insulating film is melted due to heat during reflow, with the result that the insulating film may be broken or peeled off.

SUMMARY

It is therefore an object of the present invention to provide a coil component capable of preventing the insulating film from being broken or peeled off during reflow and a manufacturing method for the coil component.

A coil component according to the present invention includes: a conductor plate; and a magnetic core made of a magnetic material having conductivity and having a through hole into which the conductor plate is inserted. The conductor plate includes: a metal element body having a body part positioned inside the through hole and a terminal part positioned outside the through hole; a metal film made of metal having a lower melting point than the metal element body and formed on the terminal part; and an insulating film formed on the surface of the body part with the metal film not interposed.

According to the present invention, the body part of the metal element body positioned inside the through hole is covered with the insulating film, preventing the magnetic core having conductivity and metal element body from being electrically short-circuited. In addition, the body part of the metal element body is covered with the insulating film with the metal film not interposed, preventing the insulating film from being broken or peeled off during reflow. Thus, a highly reliable coil component can be provided.

In the present invention, the metal element body may be bent at the boundary between the body part and the terminal part, and a part of the terminal part may be covered with the insulating film with the metal film not interposed. With this configuration, more surface area of the metal element body is covered with the insulating film, making it possible to more reliably prevent short circuits between the metal element body and the magnetic core.

In the present invention, the cross section of the metal element body may be a substantially rectangular shape having a pair of long sides and a pair of short sides, and the metal film may be selectively formed on the surfaces of the terminal part corresponding to the long sides. This can simplify the manufacturing work of the conductor plate.

In the present invention, the magnetic core may have a cut part formed by cutting the vicinity of the end portion of the through hole, and the terminal part may be housed in the cut part. This allows the volume of the magnetic core to be ensured sufficiently.

In the present invention, the magnetic core may include a first core constituting a part of the inner wall of the through hole and a second core constituting the remaining part of the inner wall of the through hole, and a magnetic gap may be formed between the first and second cores. This facilitates the work of combining the magnetic core and the conductor plate and can prevent magnetic saturation by leakage magnetic flux from the magnetic gap.

In the present invention, the through hole may include first and second through holes, the body part of the metal element body may include a first body part positioned inside the first through hole and a second body part positioned inside the second through hole, and the terminal part may include a first terminal part positioned at one end side of the first body part, a second terminal part positioned at one end side of the second body part, a third terminal part positioned at the other end side of the first body part, and a fourth terminal part positioned at the other end side of the second body part. The metal element body may further have a connection part that short-circuits the third and fourth terminal parts, and the third and fourth terminal parts may protrude from the connection part. This allows the difference in heat capacity among the first to fourth terminal parts.

In the present invention, the surface of the connection part may be covered with the insulating film with the metal film not interposed. With this configuration, more surface area of the metal element body is covered with the insulating film, making it possible to more reliably prevent short circuits between the metal element body and the magnetic core.

In the present invention, the distance between the third and fourth terminal parts may be equal to the distance between the first and second terminal parts. This facilitates the design of land patterns on a circuit board on which the coil component is mounted.

In the present invention, the first to fourth terminal parts may each have a tapered shape in which the sectional area thereof is reduced toward the tip end thereof. This facilitates the formation of a solder fillet when the coil component is mounted on a circuit board, making it possible to enhance mounting strength and connection reliability.

In the present invention, the cut part may include a first cut part housing therein the first terminal part, a second cut part housing therein the second terminal part, and a third cut part housing therein the third terminal part, fourth terminal part, and connection part. This allows the volume of the magnetic core to be sufficiently ensured.

In the present invention, the first to third cut portions may each have a tapered shape in which the opening area thereof is increased toward the tip ends of the first to fourth terminal parts. Thus, even when the mounting position of the coil component with respect to a circuit board is slightly displaced, it is possible to prevent the metal element body and magnetic core from being short-circuited through the solder fillet.

A coil component manufacturing method according to the present invention includes: a first step of preparing a metal element body having a body part and a terminal part and forming an insulating film on the surface of the body part by an electrodeposition method; a second step of forming by plating a metal film having a lower melting point than the metal element body on the surface of the terminal part on which the insulating film is not formed; and a third process of preparing a magnetic core having a through hole and combining the magnetic core and the metal element body so that the body part and the terminal part are positioned respectively inside the through hole and outside the through hole.

According to the present invention, the insulating film is formed by the electrodeposition method, so that the insulating film can be uniformly formed on the surface of the metal element body including the corner portions thereof. In addition, the metal film is formed by plating after the formation of the insulating film, so that it is possible to prevent the metal film from being interposed between the metal element body and the insulating film.

In the present invention, the first step may include a step of forming the insulating film on the entire surface of the metal element body by the electrodeposition method and a step of removing at least a part of the insulating film formed on the terminal part. This can simplify the electrodeposition process. In this case, when the process of removing the insulating film is performed by laser beam irradiation, the insulating film can be removed with high accuracy. Further, in this case, the terminal part has a tapered shape in which the sectional area thereof is reduced toward the tip end thereof and, thus, in the removal process, the insulating films on the tip surface of the terminal part and a tapered surface constituting the tapered shape may be removed simultaneously by irradiation of laser beam toward the tip end of the terminal part. This can reduce the number of processes required to remove the insulating film.

In the present invention, the first process may be performed by electrodepositing the insulting film with at least a part of the terminal part covered with a mask member. This allows the process of removing the insulating film to be omitted.

As described above, according to the present invention, there can be provided a coil component capable of preventing the insulating film from being broken or peeled off during reflow and a manufacturing method for the coil component.

BRIEF DESCRIPTION OF THE DRAWINGS

The above features and advantages of the present invention will be more apparent from the following description of certain preferred embodiments taken in conjunction with the accompanying drawings, in which.

DETAILED DESCRIPTION OF THE EMBODIMENTS

Preferred embodiments of the present invention will be explained below in detail with reference to the accompanying drawings.

First Embodiment

Figure 1:
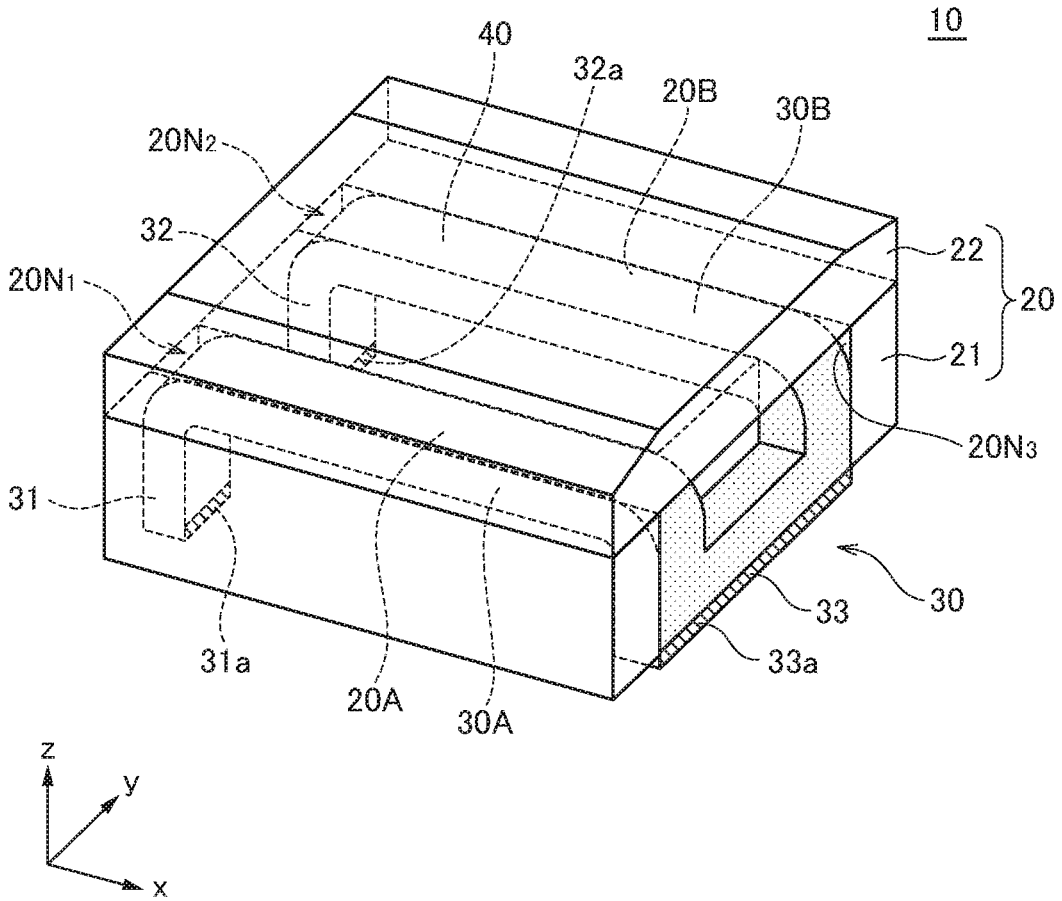
FIG. 1 is a schematic perspective view transparently illustrating the structure of a coil component according to a first embodiment of the present invention.

FIG. 1 is a schematic perspective view transparently illustrating the structure of a coil component 10 according to the first embodiment of the present invention.

The coil component 10 according to the present embodiment is an inductance element for large current used for a power supply circuit and includes a magnetic core 20 and a conductor plate 30 as illustrated in FIG. 1. The magnetic core 20 includes a first core 21 positioned at the lower side in the z-direction and a second core 22 positioned at the upper side in the z-direction. The first and second cores 21 and 22 are bonded to each other. The magnetic core 20 is made of a magnetic material having conductivity, such as MnZn-based ferrite or a metal-based magnetic body. In general, a magnetic material having conductivity like the MnZn-based ferrite has higher permeability than a magnetic material having excellent insulation properties like NiZn-based ferrite and can thus obtain larger inductance. The magnetic core 20 may be one obtained by machining a bulk magnetic material or may be a powder magnetic core obtained by press-molding magnetic particles. Further, the magnetic core 20 may be constituted by a single member, not by a combination of the first and second cores 21 and 22.

The first and second cores 21 and 22 are fixed to each other through a not-shown adhesive. The adhesive functions as a magnetic gap between the first and second cores 21 and 22, and leakage magnetic flux is generated from the magnetic gap. Therefore, it is possible to control the saturation magnetic flux density of the coil component 10 by the thickness of the adhesive. When the first and second cores 21 and 22 are combined, two through holes 20A and 20B extending in the x-direction are formed in the magnetic core 20. A part of the inner wall of each of the through holes 20A and 20B is constituted by the first core 21, and the remaining part thereof is constituted by the second core 22. The conductor plate 30 is inserted into the through holes 20A and 20B.

Figure 2:
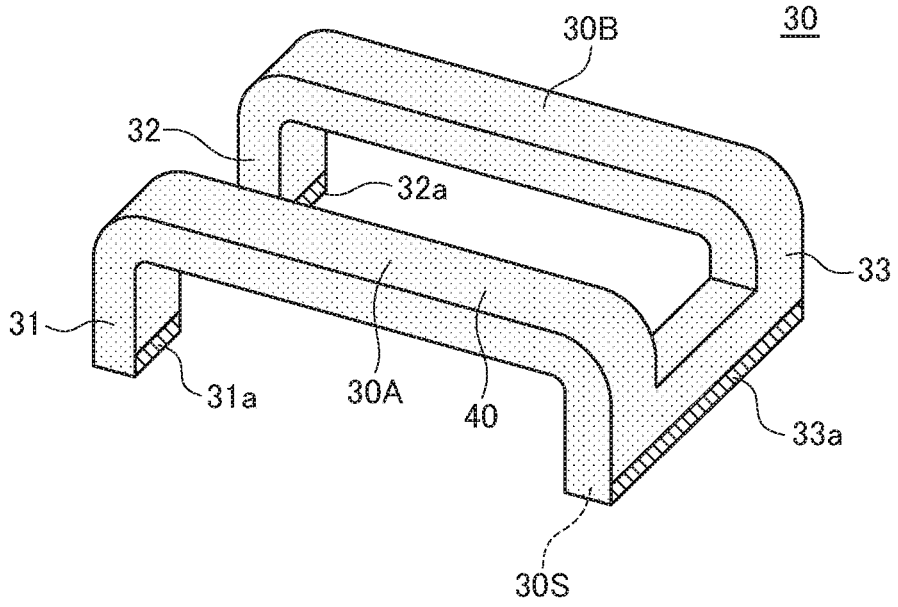
FIG. 2 is a schematic perspective view illustrating the structure of the conductor plate.
Figure 3:
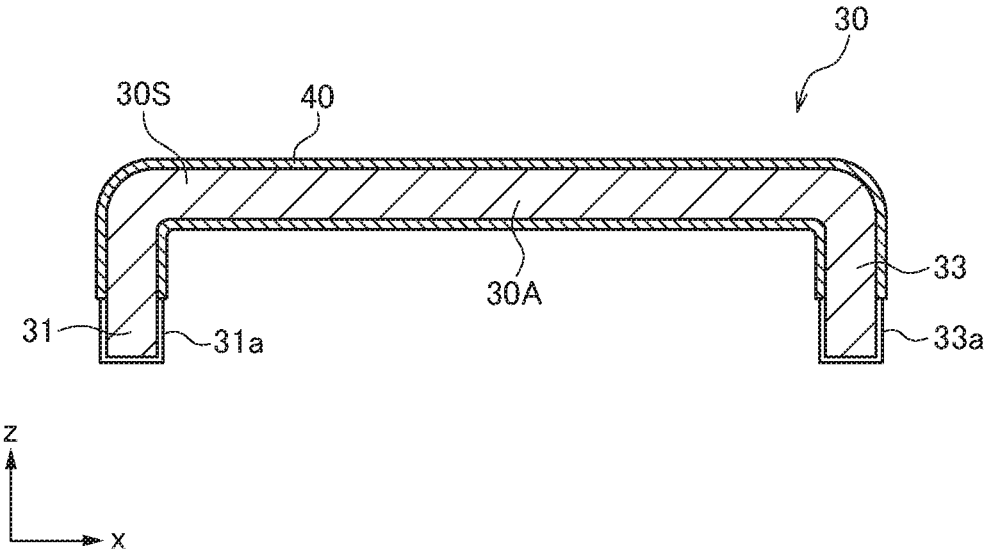
FIG. 3 is an xz cross-sectional view of the conductor plate.

FIG. 2 is a schematic perspective view illustrating the structure of the conductor plate 30, and FIG. 3 is an xz cross-sectional view of the conductor plate 30.

As illustrated in FIGS. 2 and 3, the conductor plate 30 has a configuration in which metal films 31*a* to 33*a* and an insulating film 40 are formed on the surface of a metal element body 30S having high conductivity, such as a Cu (copper) body. The metal element body 30S is formed by bending a sheet-like metal plate having a substantially rectangular shape in cross section in a substantially U-shape in a plan view (as viewed in the z-direction) and has a first body part 30A, a second body part 30B, a first terminal part 31, a second terminal part 32, and a third terminal part 33. The first and second body parts 30A and 30B extend in the x-direction and are positioned inside the first and second through holes 20A and 20B, respectively, as illustrated in FIG. 1.

The first terminal part 31 is a part formed by bending in the z-direction one end of the first body part 30A in the x-direction and serves as, e.g., an input terminal during actual use. The second terminal part 32 is a part formed by bending in the z-direction one end of the second body part 30B in the x-direction and serves as, e.g., an output terminal during actual use. The third terminal part is a part formed by bending in the z-direction a connection part connecting in the y-direction the other ends of the respective first and second body parts 30A and 30B in the x-direction and serves as, e.g., a dummy terminal during actual use. The dummy terminal is a terminal for fixing the coil component 10 to a circuit board by soldering and is not connected to a conductive pattern on the circuit board. However, the third terminal part 33 may not necessarily serve as the dummy electrode and may be used as an ordinary terminal electrode. The boundaries between the first and second body parts 30A and 30B and first to third terminal parts 31 to 33 are defined by portions where the metal element body 30S is bent by about 90° . The tip end portion of each of the first to third terminal parts 31 to 33 preferably protrudes slightly from the bottom surface of the magnetic core 20.

The surfaces of the respective first and second body parts 30A and 30B are entirely covered with the insulating film 40, and the surfaces of the respective first to third terminal parts 31 to 33 are partially covered with the first to third metal films 31*a* to 33*a*, respectively. The first to third metal films 31*a* to 33*a* are formed for ensuring solder wettability at mounting and are each made of a metal material, such as Sn or an alloy containing Sn (NiSn alloy, etc.) having a melting point lower than that of the metal element body. The film thickness of each of the first to third metal films 31*a* to 33*a* is preferably about 4 μm to about 20 μm and is preferably smaller than the film thickness of the insulating film 40. Alternatively, the first to third metal films 31*a* to 33*a* may each have a two-layer structure composed of an underlying Ni plating having a thickness of about 1 μm to about 3 μm and an Sn plating having a thickness of 4 μm to 20 μm formed on the surface of the Ni plating.

In the present embodiment, the surfaces of the first to third terminal parts 31 to 33 are covered respectively with the metal films 31*a* to 33*a* only in the vicinity of the tip end portions of the respective first to third terminal parts 31 to 33, and the remaining base portions thereof are covered with the insulating film 40. The insulating film 40 is directly formed on the surface of the metal element body 30S, and another film, particularly, a metal film made of the same metal material as those for the first to third metal films 31*a* to 33*a* is not interposed between the insulating film 40 and the surface of the metal element body 30S. Although not particularly limited, as the material for the insulating film 40, a resin material such as polyimide or epoxy resin is preferably used. The film thickness of the insulating film 40 is preferably about 5 μm to about 50 μm and more preferably about 5 μm to about 30 μm.

As illustrated in FIG. 1, three cut parts $\mathbf{20}N_1$ to $\mathbf{20}N_3$ are formed in the magnetic core 20 in the vicinity of the end portions of the first and second through holes 20A and 20B, and the first to third terminal parts 31 to 33 are housed in the cut parts $\mathbf{20}N_1$ to $\mathbf{20}N_3$, respectively. With this configuration, the first to third terminal parts 31 to 33 do not protrude from the magnetic core 20 in the x-direction, but both end portions of each thereof are sandwiched by the magnetic core 20 in the y-direction. Thus, as compared to a configuration in which the first to third terminal parts 31 to 33 protrude from the magnetic core 20, the volume of the magnetic core 20 can be increased without increase in the outside dimension.

With the above configuration, the coil component 10 according to the present embodiment can be used as an inductance element for power supply with the first and second terminal parts 31 and 32 serving, e.g., as input and output terminals, respectively. Although the magnetic core 20 is made of a magnetic material having conductivity, such as MnZn-based ferrite, the surface of the metal element body 30S is covered with the insulating film 40 at portions contacting the magnetic core 20, so that electrical short circuits between the metal element body 30S and the magnetic core 20 can be prevented. Particularly, in the present embodiment, the insulating film 40 is formed not only on the first and second body parts 30A and 30B, but also on the surfaces of the first to third terminal parts 31 to 33 except for the vicinities of the tip end portions, so that it is possible to more reliably prevent short circuits between the metal element body 30S and the magnetic core 20.

In addition, in the present embodiment, the insulating film 40 is directly formed on the metal element body 30S, and a metal film made of a metal material same as those for the first to third metal films 31*a* to 33*a* is not interposed between the insulating film 40 and the surface of the metal element body 30S. This prevents the insulating film 40 from being broken or peeled off due to heat during reflow, whereby product reliability can be enhanced.

Next, a manufacturing method for the coil component 10 according to the present embodiment will be described.

FIGS. 4 to 10 are process views for explaining the manufacturing method for the coil component 10 according to the present embodiment.

Figure 4:
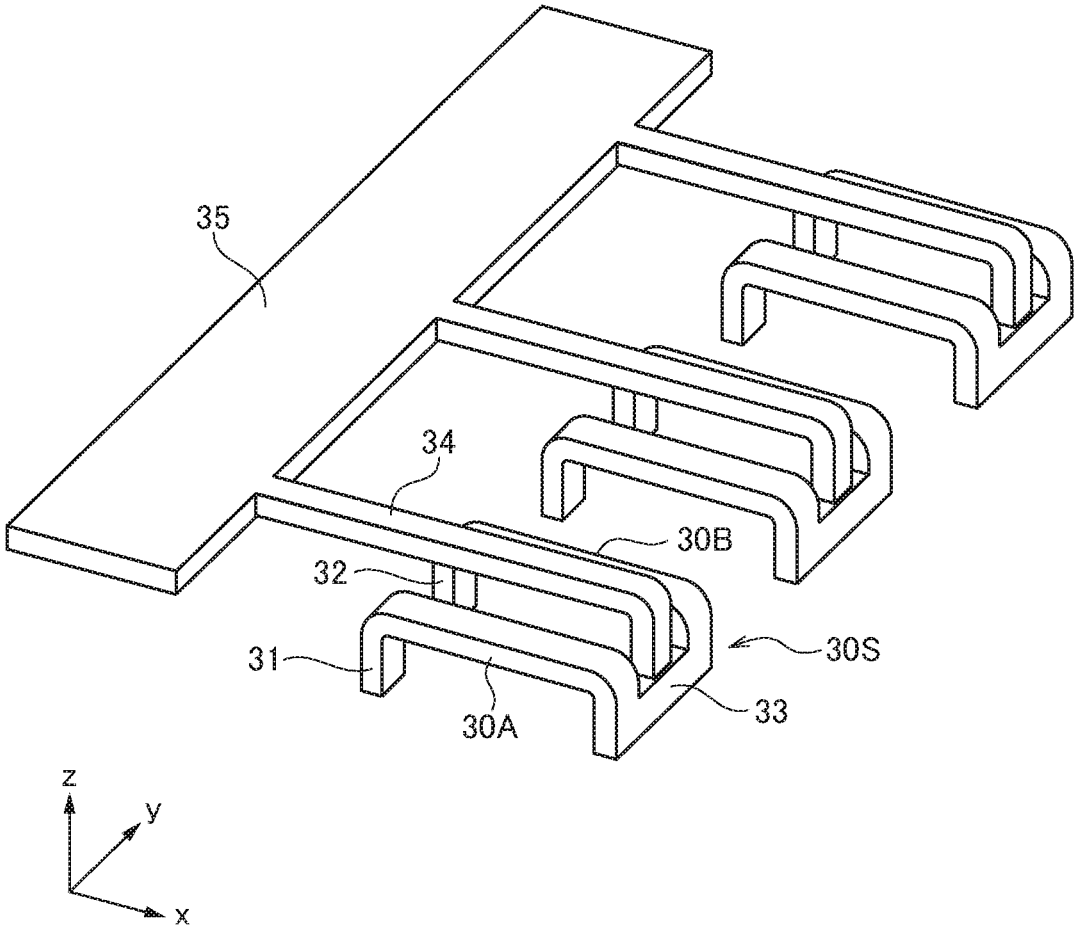
FIGS. 4 to 10 are process views for explaining the manufacturing method for the coil component according to the first embodiment of the present invention.

First, as illustrated in FIG. 4, a metal plate made of Cu (copper) or the like machined into a predetermined planar shape by punching is prepared and subjected to bending at predetermined portions to thereby form the metal element body 30S. As described above, the metal element body 30S has the first body part 30A, second body part 30B, first terminal part 31, second terminal part 32, and third terminal part 33. At this stage, a support part 34 is connected to substantially the center portion of the third terminal part 33 in the y-direction, and a plurality of the support parts 34 are connected to a frame part 35. It is preferable to form a cut or the like in the boundary between the third terminal part 33 and the support part 34 for removal of the support part 34 performed in the subsequent process.

Figure 5:
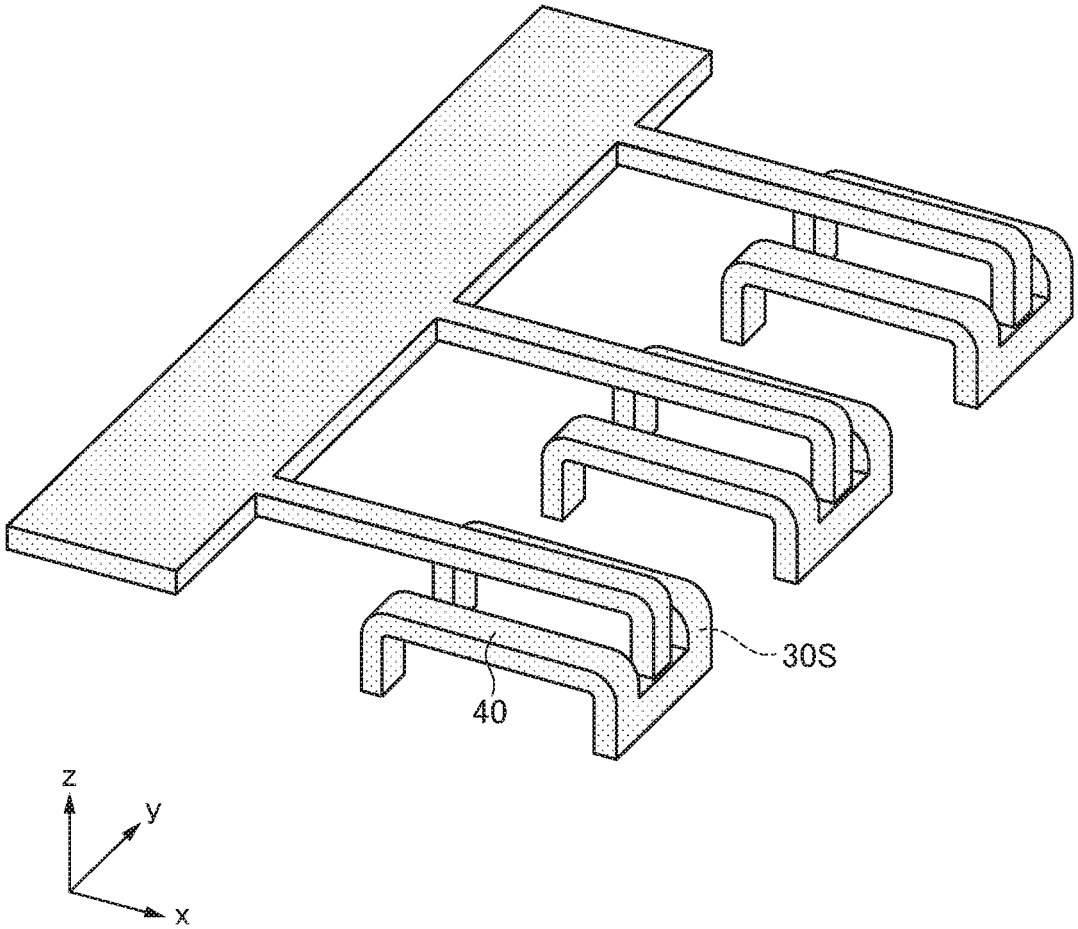

Subsequently, as illustrated in FIG. 5, the insulating film 40 made of a resin material such as polyimide or epoxy resin is formed on the entire surface of the metal element body 30S by an electrodeposition method. Using the electrodeposition method allows the insulating film 40 to be uniformly formed on the entire surface of the metal element body 30S including the corner portions thereof. On the other hand, when a fluorine-based insulating film is formed by a spraying or dipping method, the uniformity of the film thickness cannot be sufficiently ensured. Particularly, the film thickness becomes very small at the corner portions, which may expose the metal element body 30S at the corner portions. On the other hand, when the insulating film 40 is formed by the electrodeposition method, it is possible to uniformly form the insulating film 40 on the entire surface of the metal element body 30S including the corner portions.

Figure 6:
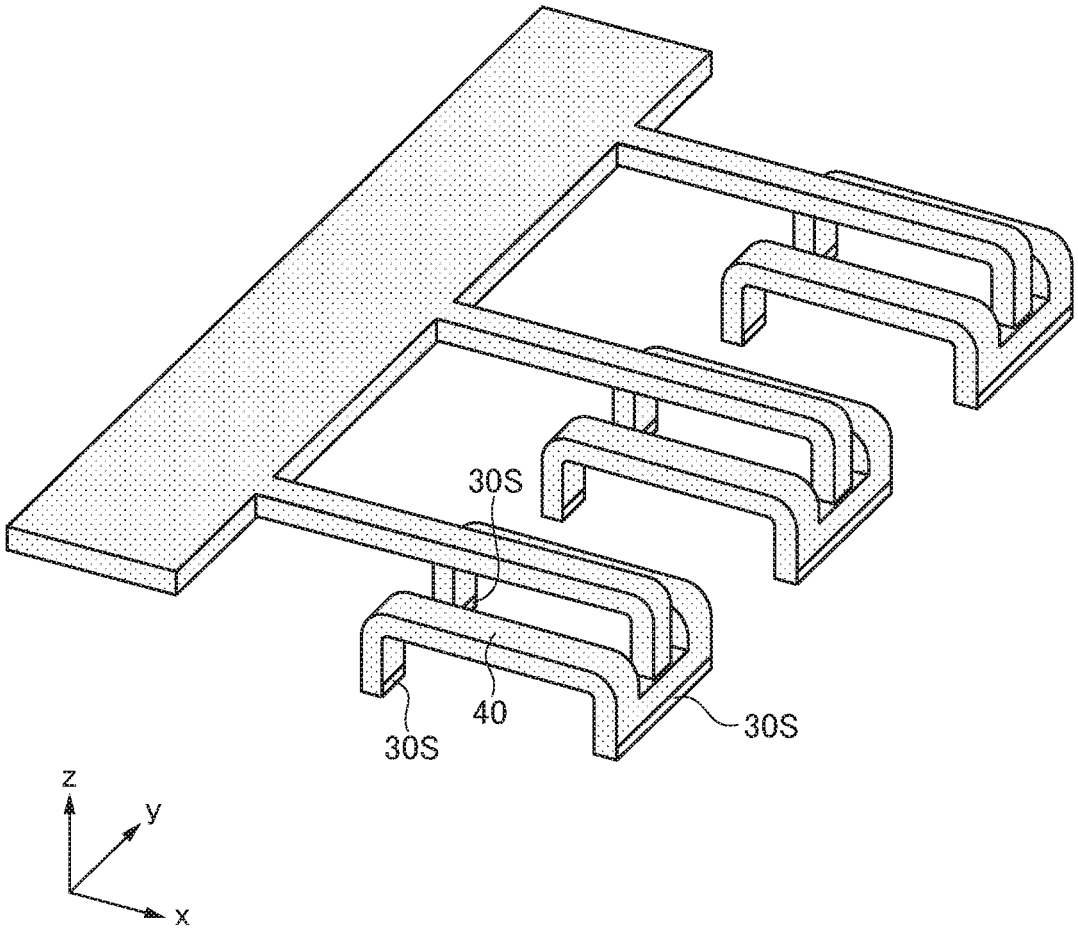

Subsequently, as illustrated in FIG. 6, the insulating film 40 formed in the vicinity of the tip end portion of each of the first to third terminal parts 31 to is selectively removed. Although the method for removing the insulating film 40 is not particularly limited, the insulating film 40 can be subjected to ablation by laser beam irradiation or physical removal using a file. Particularly, using leaser beam allows the insulating film 40 to be removed with high accuracy. In the example of FIG. 6, removal of the insulating film 40 is not performed for the entire periphery in the vicinity of the tip end portion of each of the first to third terminal parts 31 to 33. More specifically, removal of the insulating film 40 is not performed for the xz plane. The xz plane of each of the first to third terminal parts 31 to 33 is a plane corresponding to a pair of short sides of the flat-plate like metal element body 30S having a substantially rectangular shape in cross section. The removal of the insulating film 40 may be performed also for the xz plane of each of the first to third terminal parts 31 to 33. However, in the present embodiment, the first to third terminal parts 31 to 33 are housed in the cut parts $\mathbf{20}N_1$ to $\mathbf{20}N_3$ of the magnetic core 20, respectively, so that the magnetic core 20 exists in the vicinity of the first to third terminal parts 31 to 33 in the y-direction. Thus, when removal of the insulating film 40 is performed for the xz plane, the metal films 31*a* to 33*a* are inevitably formed on the xz plane in the subsequent process, which may cause short circuits between the xz plane of each of the first to third terminal parts 31 to 33 and the magnetic core 20 through a solder. To prevent this, it is preferable that the insulating film 40 on the xz plane of each of the first to third terminal parts 31 to 33 is not removed but left there. In this case, there is no need to perform the removal process of the insulating film 40 for the xz plane, thereby simplifying the manufacturing process.

Figure 7:
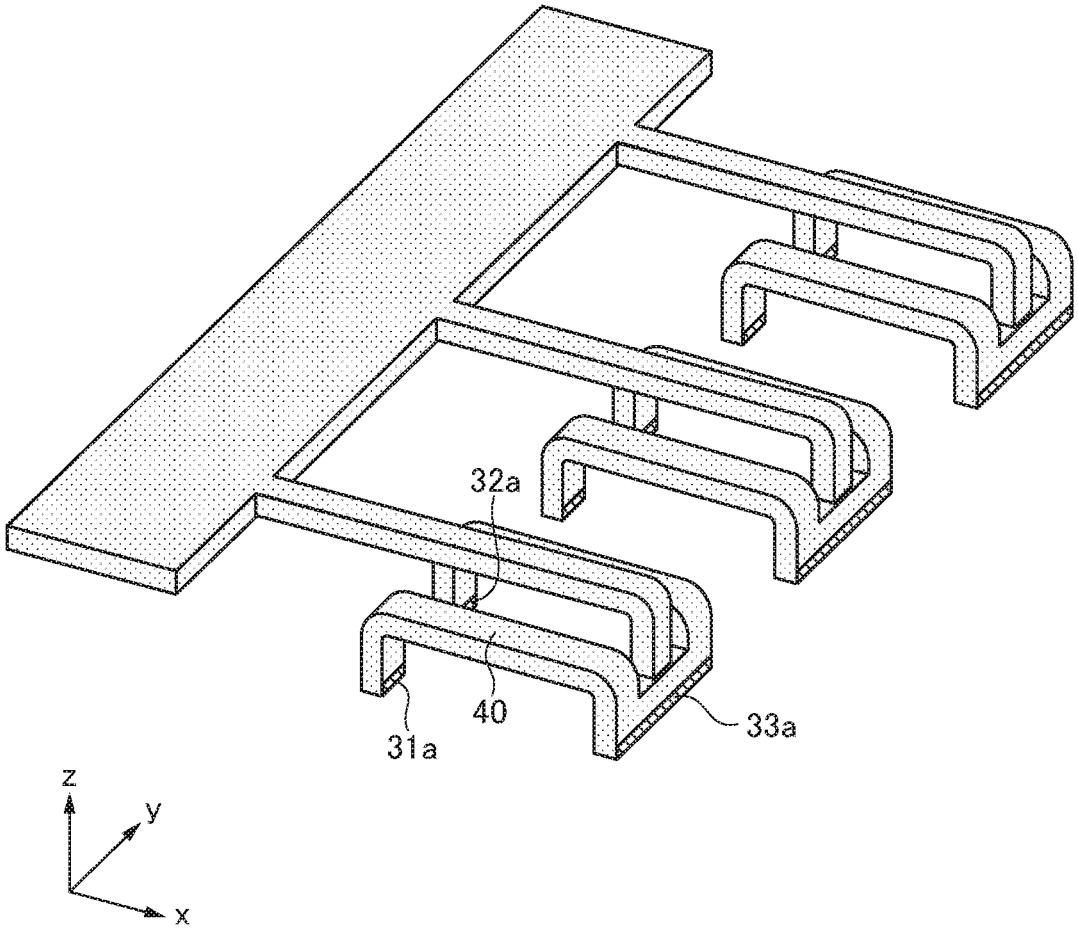

Subsequently, as illustrated in FIG. 7, the metal films 31*a* to 33*a* are formed by plating respectively on the surfaces of the first to third terminal parts 31 to 33 exposed by the removal of the insulating film 40. In this process, the insulating film 40 functions as a plating mask, making it possible to selectively form the metal films 31*a* to 33*a* only on the exposed surfaces of the respective first to third terminal parts 31 to 33. The exposed surface of each of the first to third terminal parts 31 to 33 is the yz plane corresponding to a pair of long sides of the flat-plate like metal element body 30S having a substantially rectangular shape in cross section and the xy plane at the base end thereof. The insulating film 40 serving as the plating mask is formed by the electrodeposition method, and the entire surface including the corner portions of the metal element body 30S is uniformly covered with the insulating film 40, so that the metal film is not plated on an unintended part. As described above, when a fluorine-based insulating film is formed by a spraying or dipping method, the metal element body 30S may be exposed at the corner portions and, in this case, the metal film is formed on the exposed metal element body 30S. To prevent this, a metal film made of tin or the like is previously formed on the entire surface of the metal element body 30S, and then the insulating film 40 is formed on necessary portions (body parts 30A and 30B). In this case, however, the metal film is interposed between the metal element body 30S and the insulating film 40. On the other hand, in the present embodiment, the insulating film is formed by the electrodeposition method, and then plating is performed for the exposed surface not covered with the insulating film 40, so that such a problem does not occur.

Figure 8:
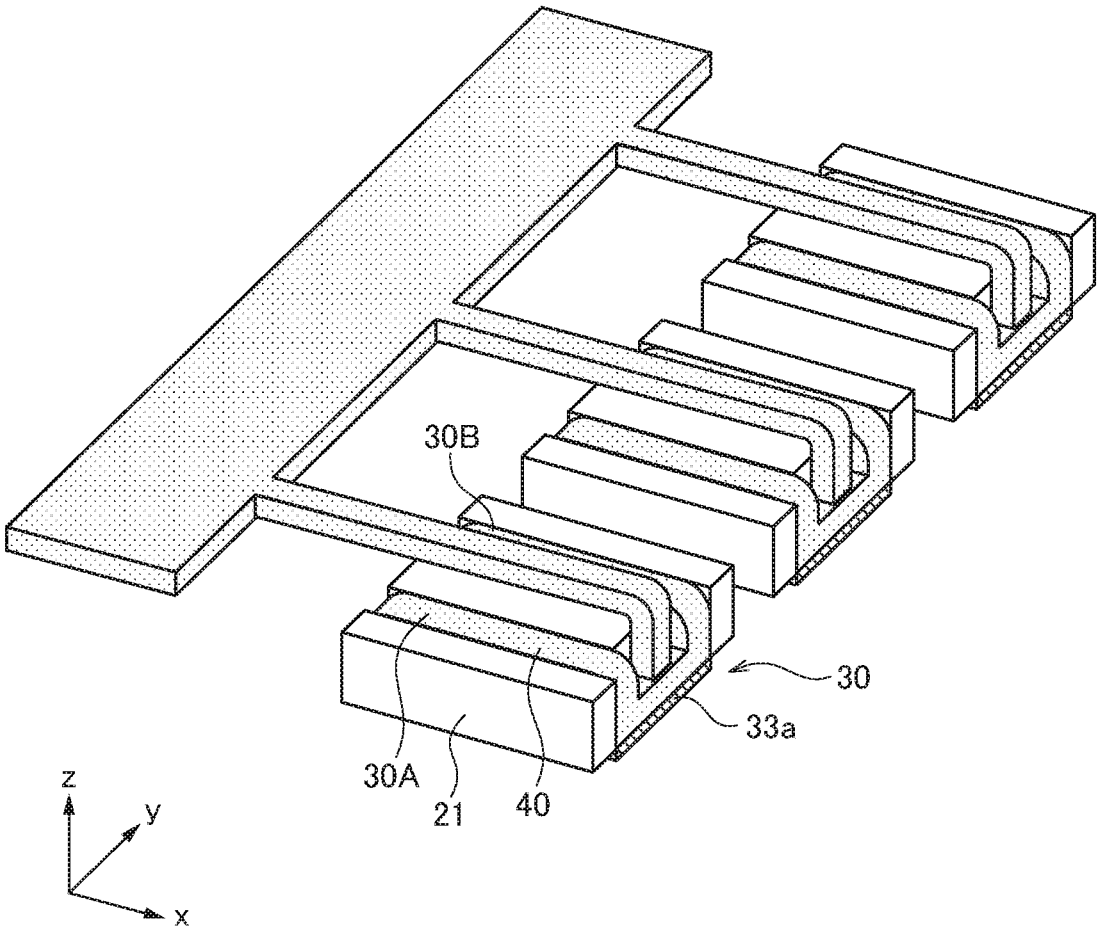
Figure 9:
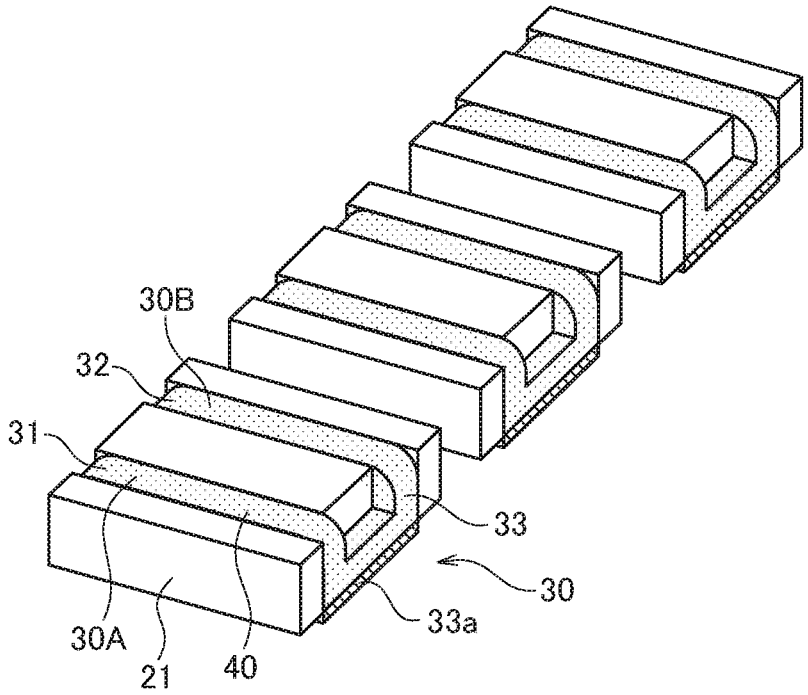
Figure 10:
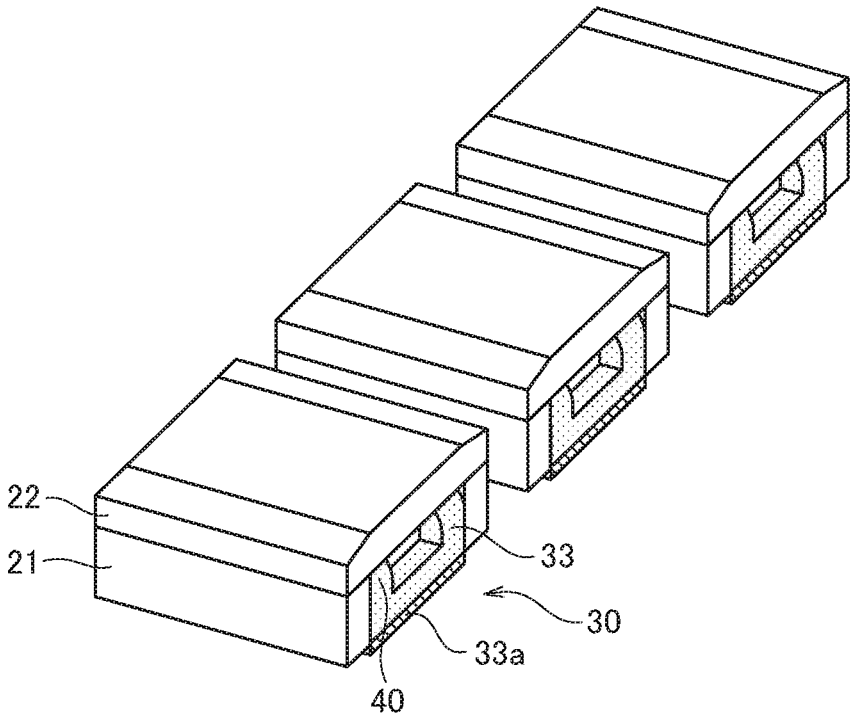

Subsequently, as illustrated in FIG. 8, the conductor plate 30 and the first core 21 are combined so that the first and second body parts 30A and 30B are housed in grooves as the through holes 20A and 20B, respectively, and then the third terminal part 33 and the support part 34 are separated from each other as illustrated in FIG. 9. Then, as illustrated in FIG. 10, the second core 22 is bonded to the first core 21, whereby the coil component 10 according to the present embodiment is completed.

As described above, in the manufacturing process of the coil component 10, the metal films 31*a* to 33*a* are formed after electrodeposition of the insulating film 40 and partial removal thereof are performed, so that the insulating film 40 and metal films 31*a* to 33*a* can be formed on mutually different surfaces of the metal element body 30S. Thus, the metal film is not interposed between the metal element body 30S and the insulating film 40, preventing the insulating film 40 from being broken or peeled off due to heat during reflow. In addition, the insulating film 40 functions as a plating mask, allowing the metal films 31*a* to 33*a* to be selectively formed by plating without forming a plating mask separately.

Second Embodiment

Figure 11:
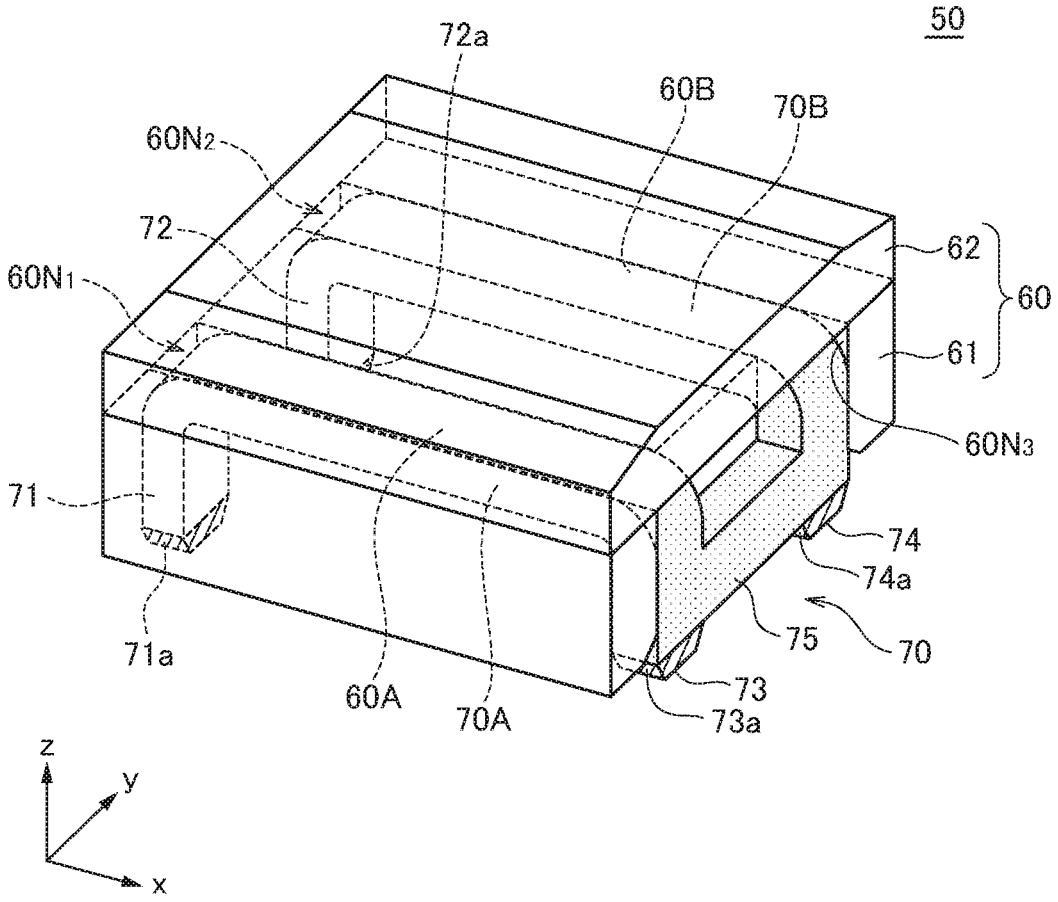
FIG. 11 is a schematic perspective view transparently illustrating the structure of a coil component according to a second embodiment of the present invention.
Figure 12:
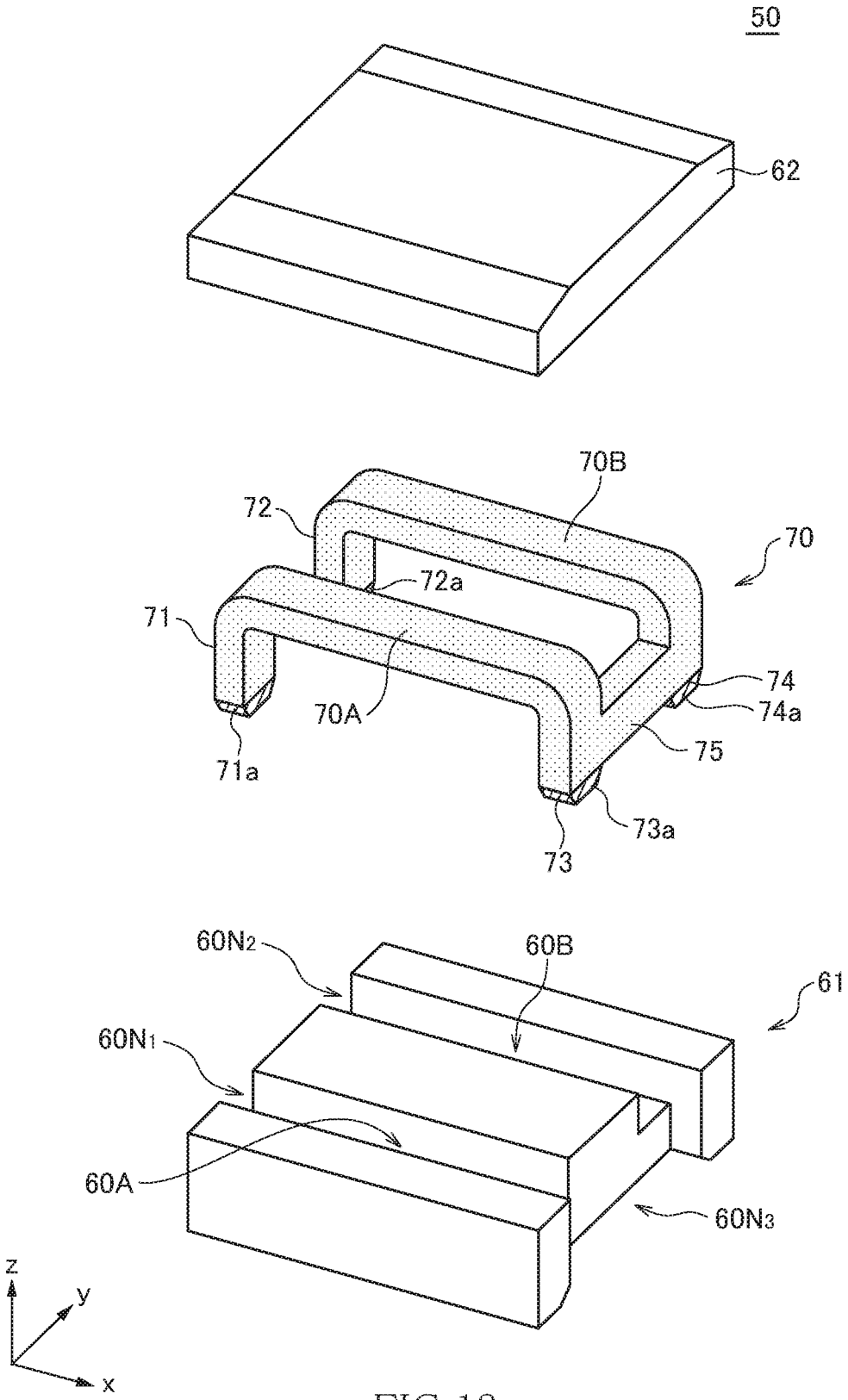
FIG. 12 is an exploded perspective view of the coil component according to the second embodiment of the present invention.

FIG. 11 is a schematic perspective view transparently illustrating the structure of a coil component 50 according to the second embodiment of the present invention. FIG. 12 is an exploded perspective view of the coil component 50 according to the second embodiment.

As illustrated in FIGS. 11 and 12, the coil component 50 according to the second embodiment includes a magnetic core 60 and a conductor plate 70. The magnetic core 60 corresponds to the magnetic core 20 of the first embodiment and has a configuration in which a first core 61 and a second core 62 are bonded to each other. The conductor plate 70 corresponds to the conductor plate 30 of the first embodiment and has a first body part 70A, a second body part 70B, first to fourth terminal parts 71 to 74, and a connection part 75. The first and second body parts 70A and 70B extend in the x-direction and are positioned inside respective first and second through holes 60A and 60B formed in the magnetic core 60, as illustrated in FIG. 11.

The connection part 75 is a part that short-circuits the third and fourth terminal parts 73 and 74, and the third and fourth terminal parts 73 and 74 protrude from the connection part 75 in the z-direction. Thus, unlike the coil component 10 according to the first embodiment, the coil component 50 according to the second embodiment has a four-terminal structure.

Figure 13:
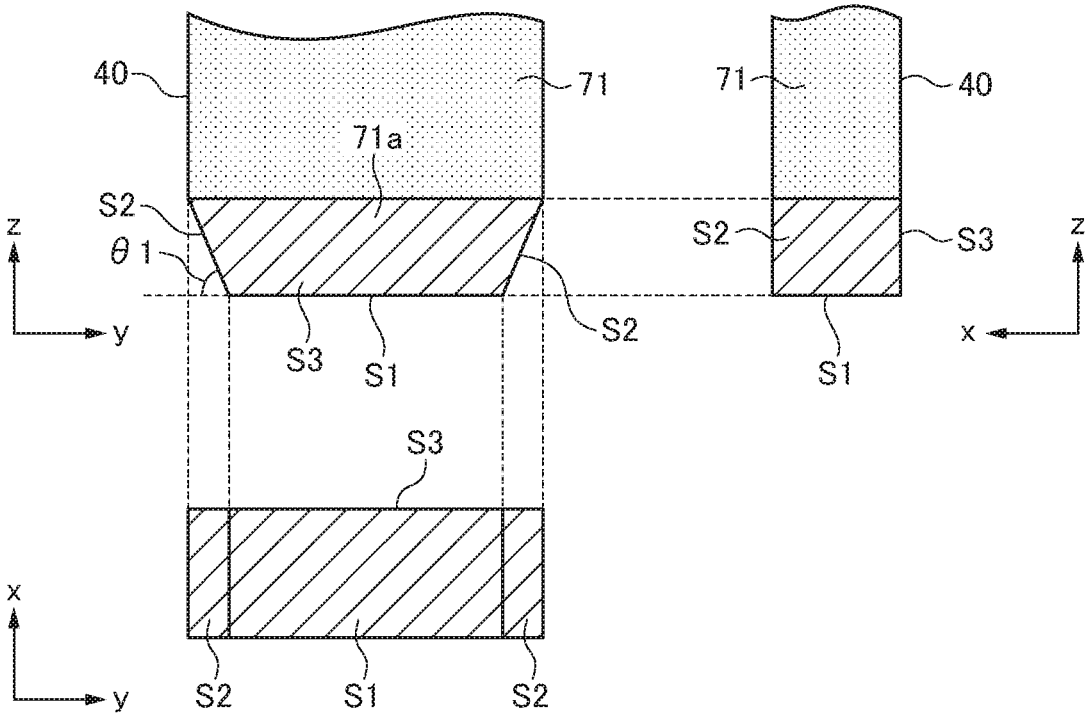
FIG. 13 is a view for explaining in more detail the shape of the first terminal part.

FIG. 13 is a view for explaining in more detail the shape of the first terminal part 71.

As illustrated in FIG. 13, the first terminal part 71 has a tapered shape in which the sectional area thereof is reduced toward the tip end thereof. That is, the first terminal part 71 has a tip surface S1 constituting the xy plane, a pair of tapered surfaces S2 inclined by an angle θ1 with respect to the tip surface S1, and a pair of side surfaces S3 constituting the yz plane, and the surfaces S1 to S3 are covered with a metal film 71*a*. As for the remaining part of the first terminal part 71, the surface of the metal element body 70S is covered with the insulating film 40 with the metal film 71*a* not interposed. Although the value of the angle θ1 of the tapered surface S2 is not particularly limited, it is preferably in the range of 60° to 80°.

Although not illustrated, the terminal parts 72 to 74 each have the same shape as that of the first terminal part 71. That is, the terminal parts 72 to 74 each have the tip surface S1, tapered surfaces S2, and side surfaces S3, and the surfaces S1 to S3 of the respective terminal parts 72 to 74 are covered respectively with the metal films 72*a* to 74*a*. As for the remaining part of each of the terminal parts 72 to 74, the first body part 70A, second body part 70B, and connection part 75, the surface of the metal element body 70S is covered with the insulating film 40 with the metal film (71*a* to 74*a*) not interposed.

Figure 14:
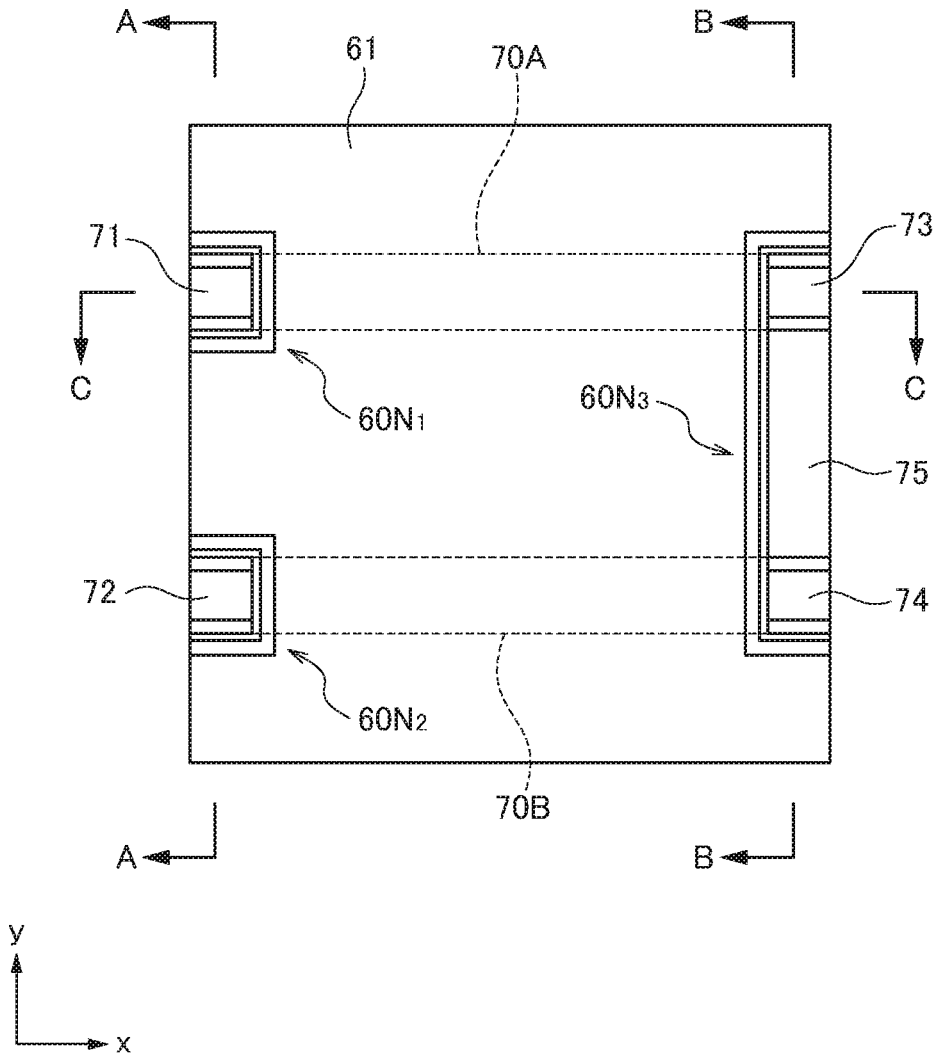
FIG. 14 is a plan view illustrating the shape of the bottom surface of the coil component according to the second embodiment of the present invention.
Figure 15A:
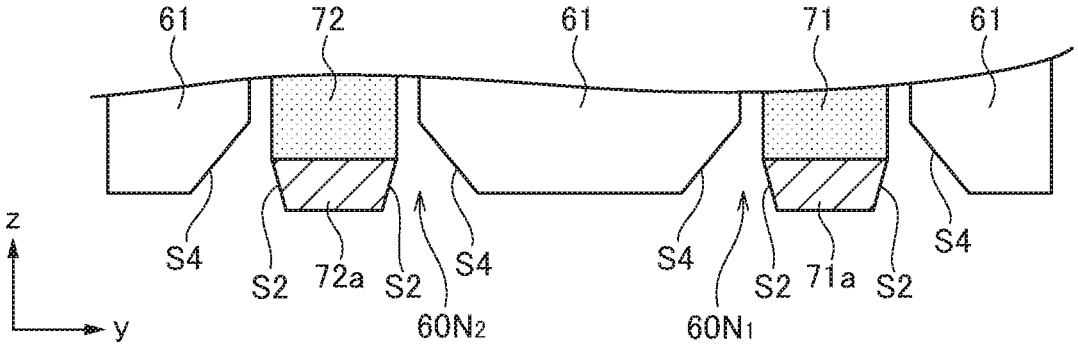
FIGS. 15A to 15C are partial cross-sectional views taken along lines A-A, B-B, and C-C of FIG. 14, respectively.
Figure 15B:
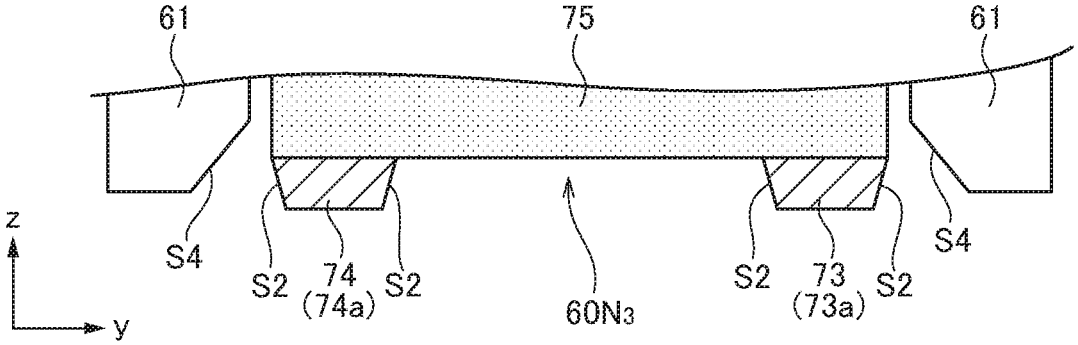
Figure 15C:
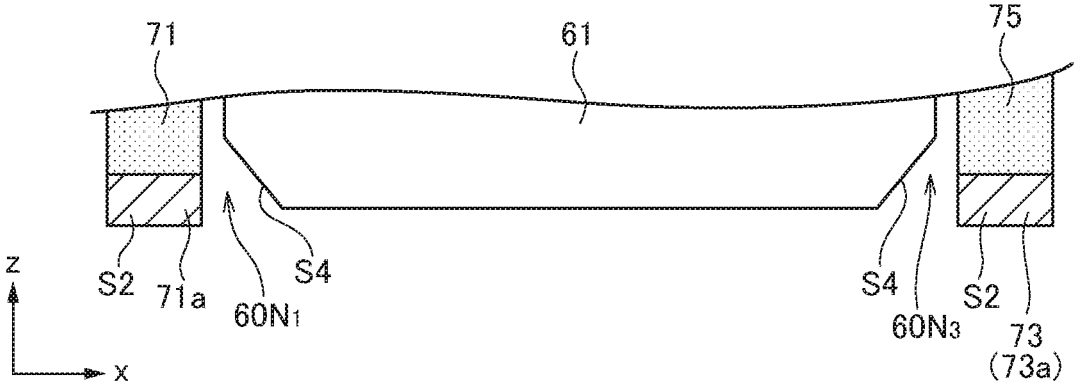

FIG. 14 is a plan view illustrating the shape of the bottom surface of the coil component 50, and FIGS. 15A to 15C are partial cross-sectional views taken along lines A-A, B-B, and C-C of FIG. 14, respectively.

As illustrated in FIG. 14 and FIGS. 15A to 15C, the magnetic core 60 has three cut parts 60$N_1$ to 60$N_3$. The first terminal part 71 is housed in the cut part 60$N_1$, the second terminal part 72 is housed in the cut part 60$N_2$, and the third terminal part 73, fourth terminal part 74, and connection part 75 are housed in the cut part 60$N_3$. The cut parts 60$N_1$ to 60$N_3$ each have a tapered shape in which the opening area thereof is increased toward the tip ends of the terminal parts 71 to 74. That is, out of the surfaces of the first core 61 constituting the cut parts 60$N_1$ to 60$N_3$, those facing the terminal parts 71 to 74 constitute the tapered surfaces S4, whereby the distance between the metal films 71*a* to 74*a* formed on the respective terminal parts 71 to 74 and the first core 61 is increased toward the terminal tip end.

Figure 16:
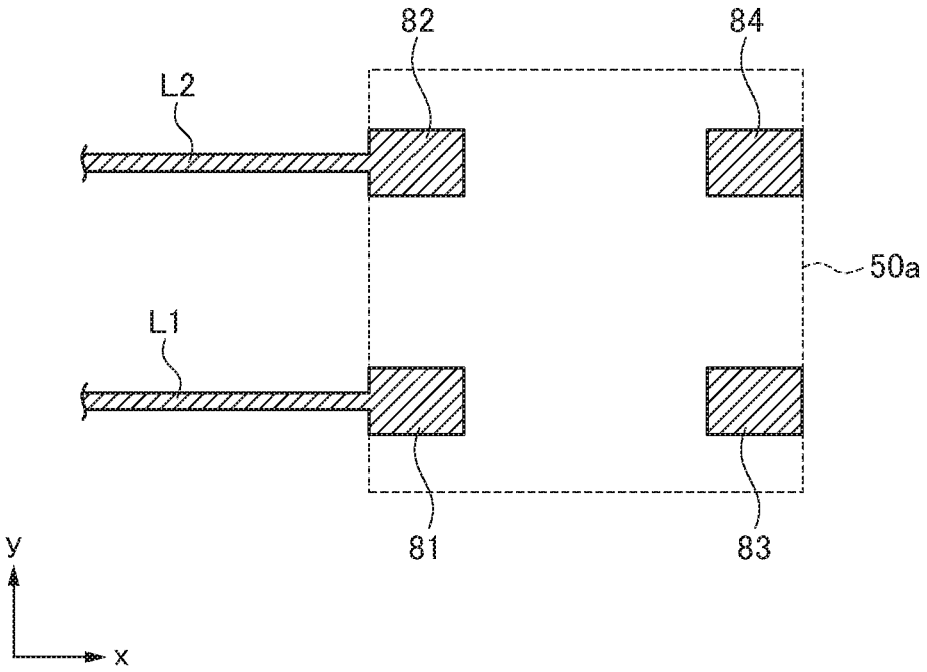
FIG. 16 is a plan view illustrating the pattern shape of a conductor pattern on a circuit board on which the coil component according to the second embodiment of the present invention is mounted.

FIG. 16 is a plan view illustrating the pattern shape of a conductor pattern on a circuit board on which the coil component 50 is mounted.

A reference numeral 50*a* in FIG. 16 indicates the mounting area of the coil component 50, and four land patterns 81 to 84 are formed on the mounting area 50*a*. The land patterns 81 to 84 are connected respectively to the terminal parts 71 to 74. The land patterns 81 and 82 are connected respectively with wiring patterns L1 and L2, while the land patterns 83 and 84 are not connected with the wiring pattern and used exclusively for mechanical fixation. However, the land patterns 83 and 84 may each be connected with the wiring pattern. In the example of FIG. 16, the distance between the land patterns 81 and 82 in the y-direction and the distance between the land patterns 83 and 84 in the y-direction are equal to each other. This is because the distance between the terminal parts 71 and 72 in the y-direction and the distance between the terminal parts 73 and 74 in the y-direction are equal to each other.

Figure 17A:
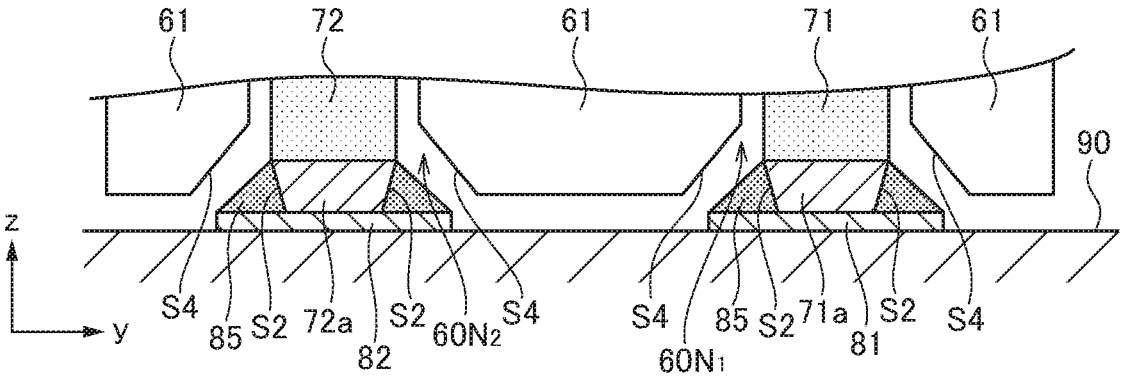
FIGS. 17A to 17C are views each illustrating a state where the coil component 50 is mounted on a circuit board by soldering.
Figure 17B:
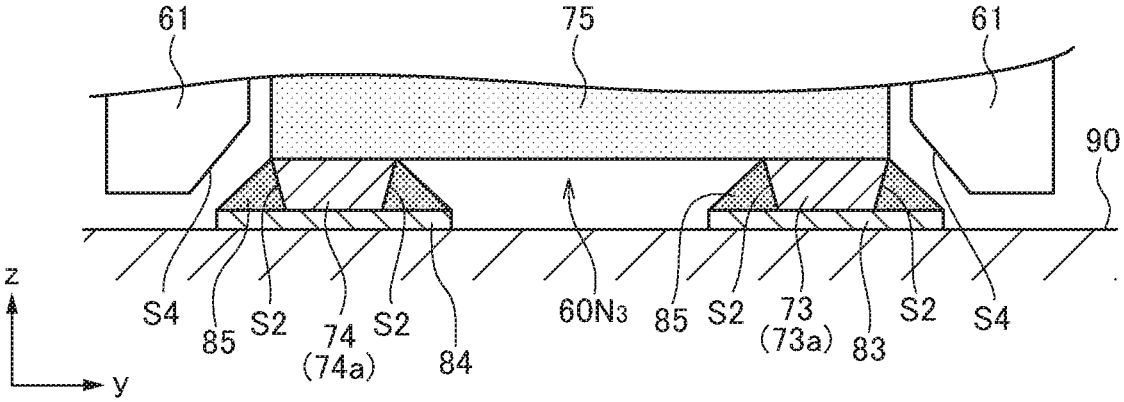
Figure 17C:
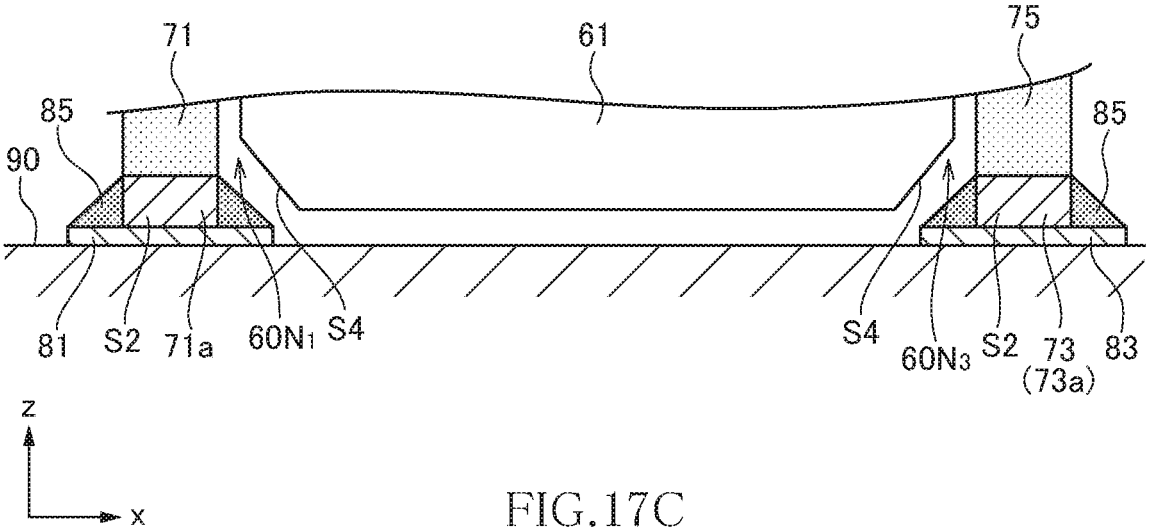

FIGS. 17A to 17C are views each illustrating a state where the coil component 50 is mounted on a circuit board 90 by soldering and correspond to partial cross sections of FIGS. 15A to 15C, respectively.

As illustrated in FIGS. 17A to 17C, the coil component 50 is mounted on the circuit board 90 such that the terminal parts 71 to 74 and the land patterns 81 to 84 overlap each other, respectively, and then each terminal part and each land pattern are connected by a solder 85. As a result, the solder 85 forms a fillet covering the tapered surfaces S2 and side surfaces S3. The fillet of the solder 85 has a shape such that the size thereof in the x- or y-direction is increased toward the circuit board 90; however, in the present embodiment, the cut parts 60$N_1$ to 60$N_3$ of the magnetic core 60 each have the tapered surface S4 corresponding to the fillet shape, so that even when the mounting position of the coil component 50 is slightly displaced, the fillet of the solder 85 and the magnetic core 60 do not contact with each other. In addition, the tapered surfaces S2 of each of the terminal parts 71 to 74 are not vertical to the circuit board 90, but have the smaller angle θ1, facilitating the formation of the fillet of the solder 85.

As described above, the coil component 50 according to the present embodiment has the four terminal parts 71 to 74, so that the difference in heat capacity among the terminal parts 71 to 74 is reduced. Thus, melting of the solders 85 occurs at substantially simultaneously at the terminal parts 71 to 74 during reflow, thereby making it possible to prevent an unintended rotation of the component due to the difference in melt timing. In addition, as described above, the cut parts 60$N_1$ to 60$N_3$ of the magnetic core 60 each have the tapered shape, making it also possible to prevent contact between the filler of the solder 85 and the magnetic core 60.

Next, a manufacturing method for the coil component 50 according to the present embodiment will be described.

FIGS. 18 to 24 are process views for explaining the manufacturing method for the coil component 50 according to the present embodiment.

Figure 18:
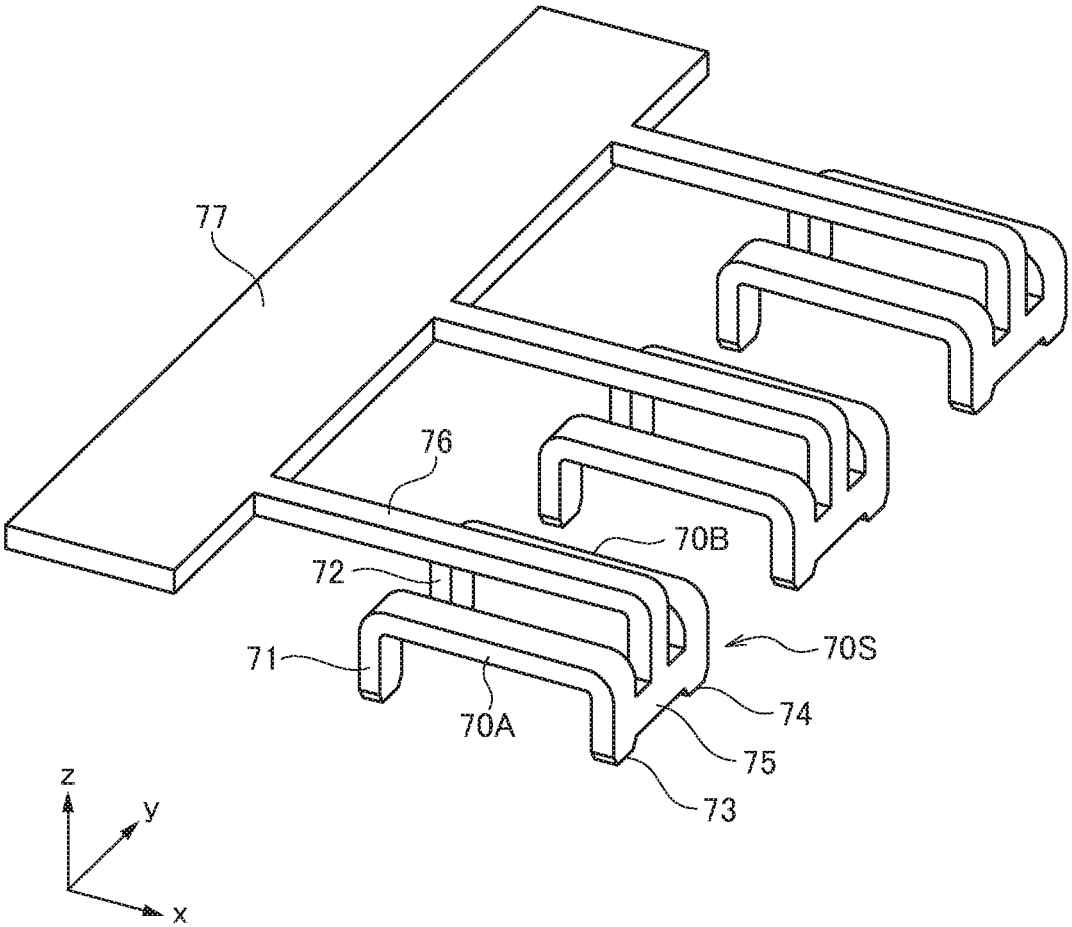
FIGS. 18 to 24 are process views for explaining the manufacturing method for the coil component according to the second embodiment of the present invention.
Figure 19:
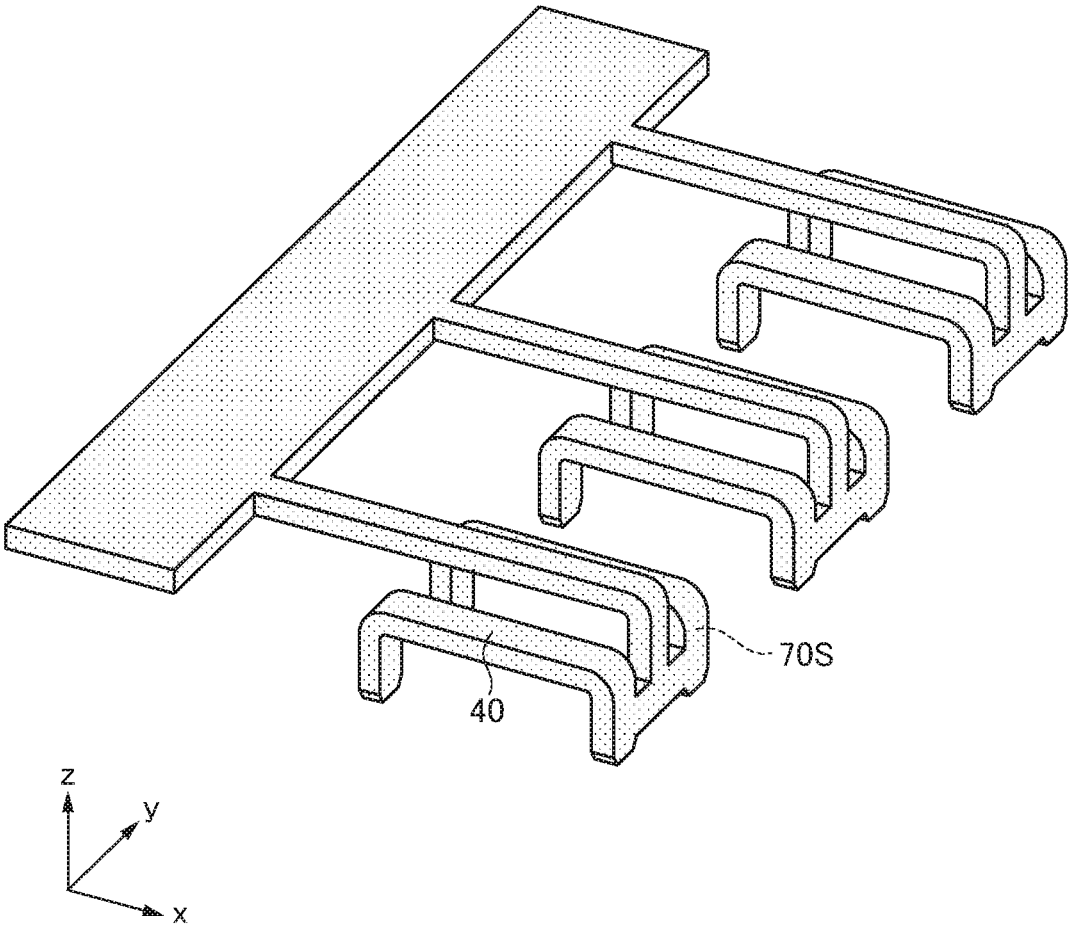

First, as illustrated in FIG. 18, a metal plate made of Cu (copper) or the like machined into a predetermined planar shape by punching is prepared and subjected to bending at predetermined portions to thereby form a metal element body 70S. The metal element body 70S has the first body part 70A, second body part 70B, first to fourth terminal parts 71 to 74, and connection part 75. At this stage, a support part 76 is connected to substantially the center portion of the connection part 75 in the y-direction, and a plurality of the support parts 76 are connected to a frame part 77. In this state, as illustrated in FIG. 19, the insulating film 40 made of a resin material such as polyimide or epoxy resin is formed on the entire surface of the metal element body 70S by the electrodeposition method.

Figure 20:
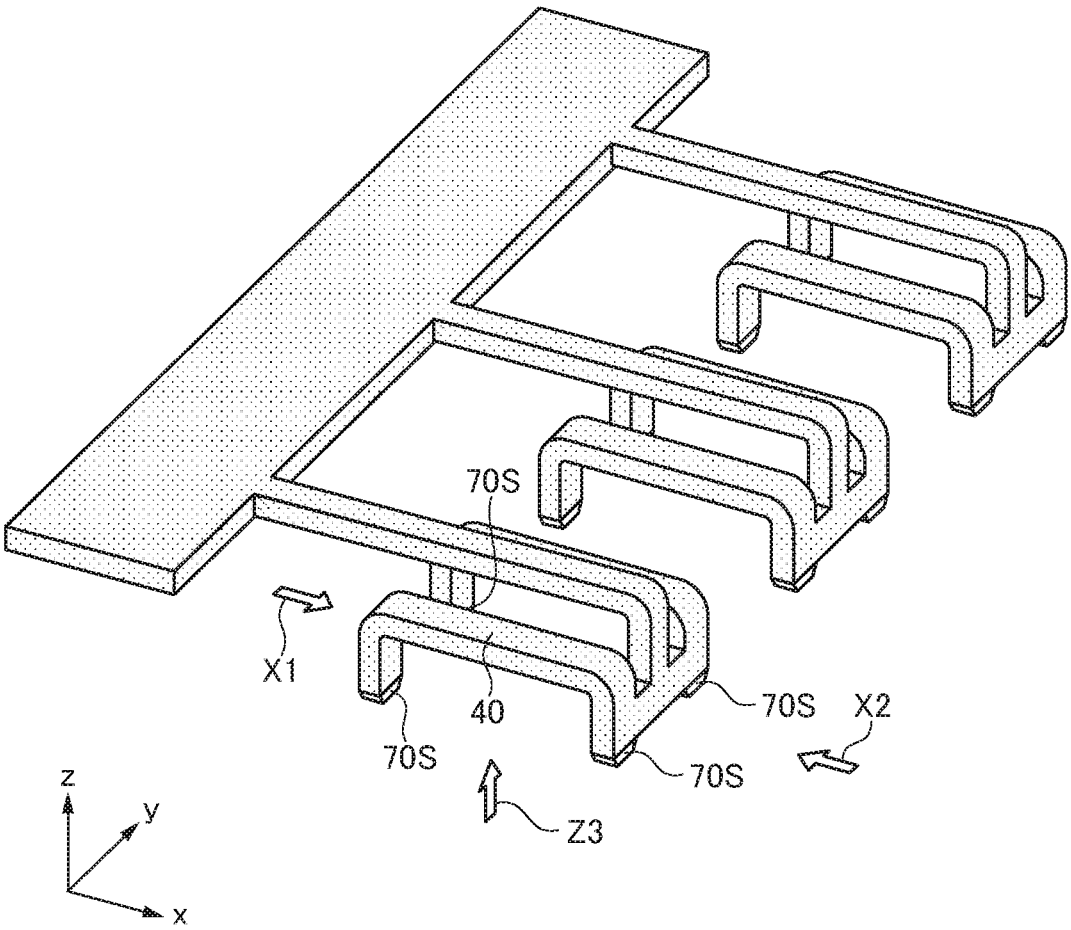

Subsequently, as illustrated in FIG. 20, laser beam is irradiated onto the vicinities of the tip end portions of the respective first to fourth terminal parts 71 to 74 to selectively remove the insulating film 40. The laser beam is irradiated at least in the directions X1, X2, and Z3 illustrated in FIG. 20. The laser beam irradiation in the direction X1 removes the insulating film 40 formed on one side surface S3 of each of the terminal parts 71 to 74, and laser beam irradiation in the direction X2 removes the insulating film 40 formed on the other side surface S3 of each of the terminal parts 71 to 74. Further, the laser beam irradiation in the direction Z3 removes simultaneously the insulating films 40 on the tip surface S1 of each of the terminal parts 71 to 74 and the tapered surface S2 thereof. This is because the tapered surfaces S2 are exposed as viewed from the z-direction in FIG. 13. As a result, the insulating films 40 formed respectively on the tip surface S1, tapered surfaces S2, and both side surfaces S3 of each of the terminal parts 71 to 74 are removed, and the metal element body 70S is exposed again at each of the above portions where the insulating film 40 is removed.

Figure 21:
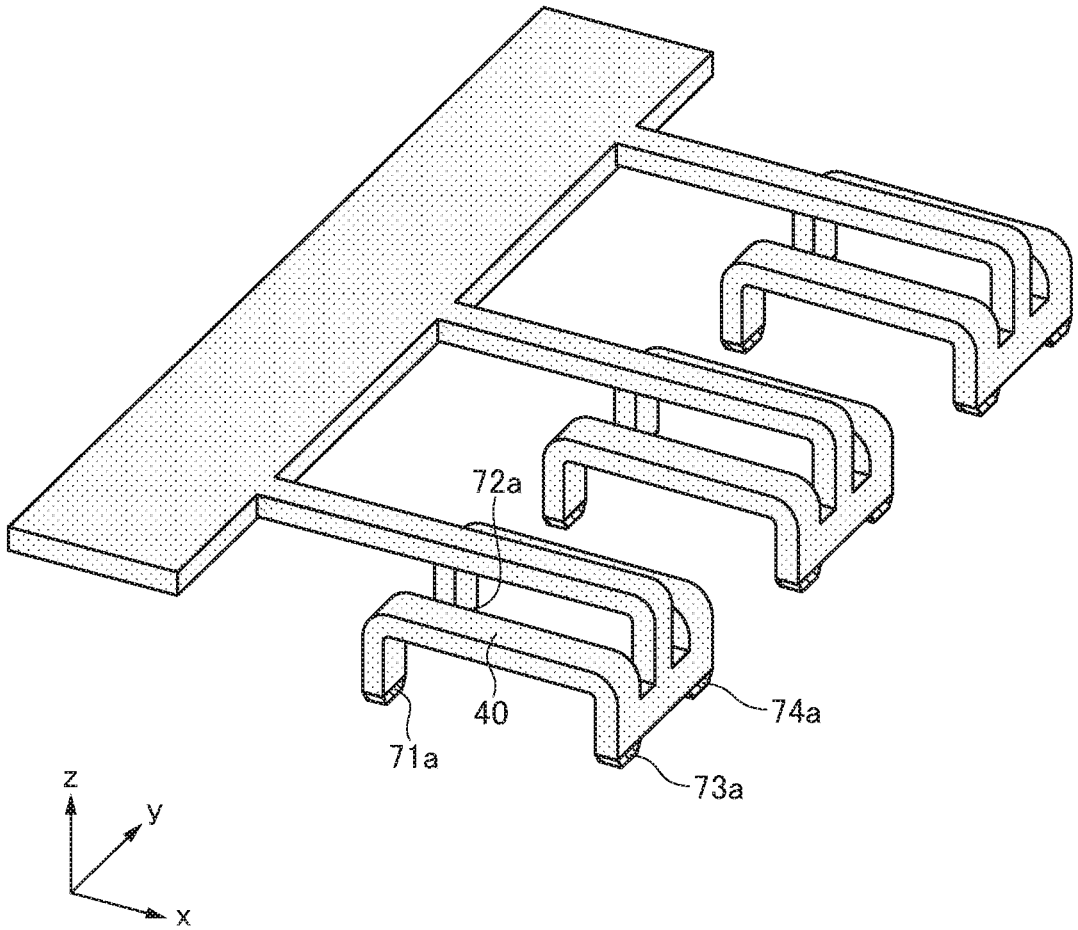

Subsequently, as illustrated in FIG. 21, the metal films 71*a* to 74*a* are formed by plating respectively on the surfaces of the first to fourth terminal parts 71 to 74 exposed by the removal of the insulating film 40. In this process, the insulating film 40 functions as a plating mask, making it possible to selectively form the metal films 71*a* to 74*a* only on the exposed surfaces of the respective first to fourth terminal parts 71 to 74.

Figure 22:
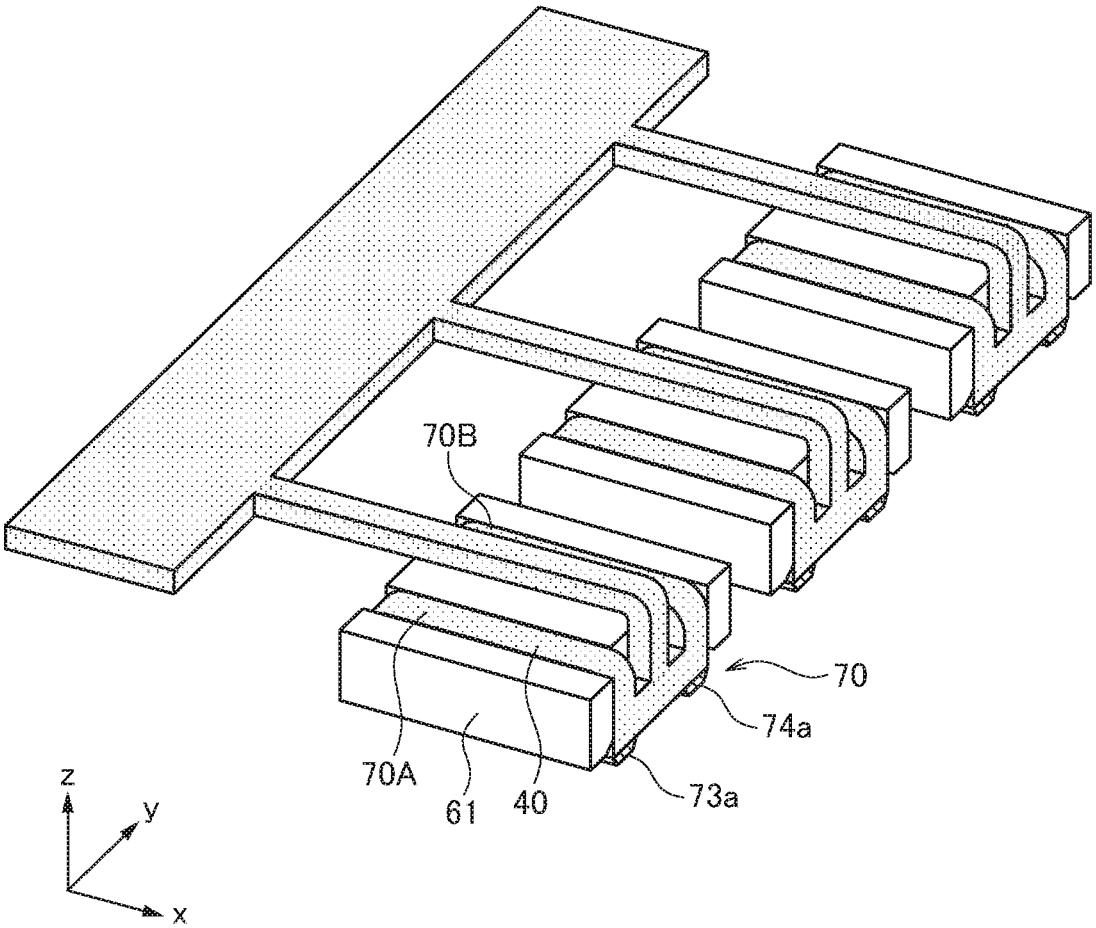
Figure 23:
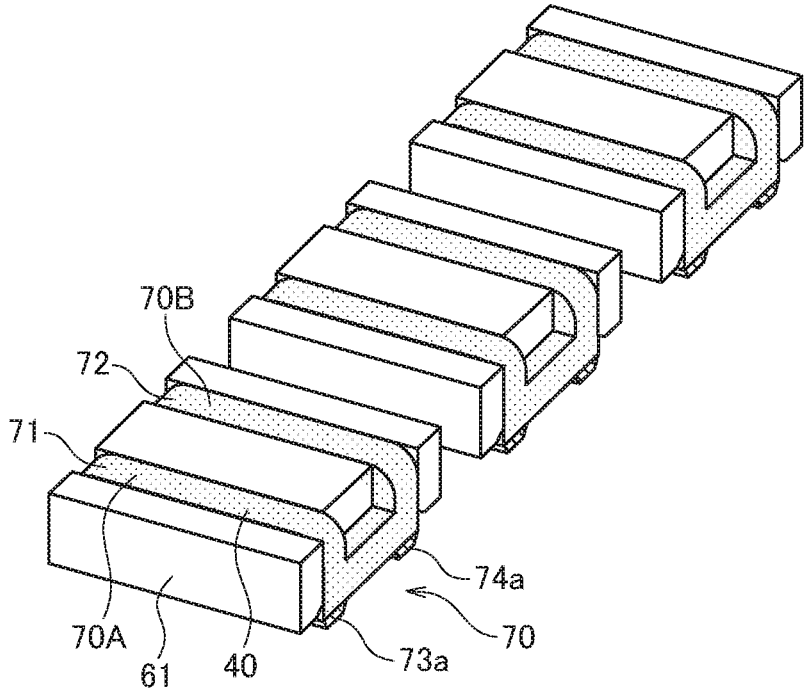
Figure 24:
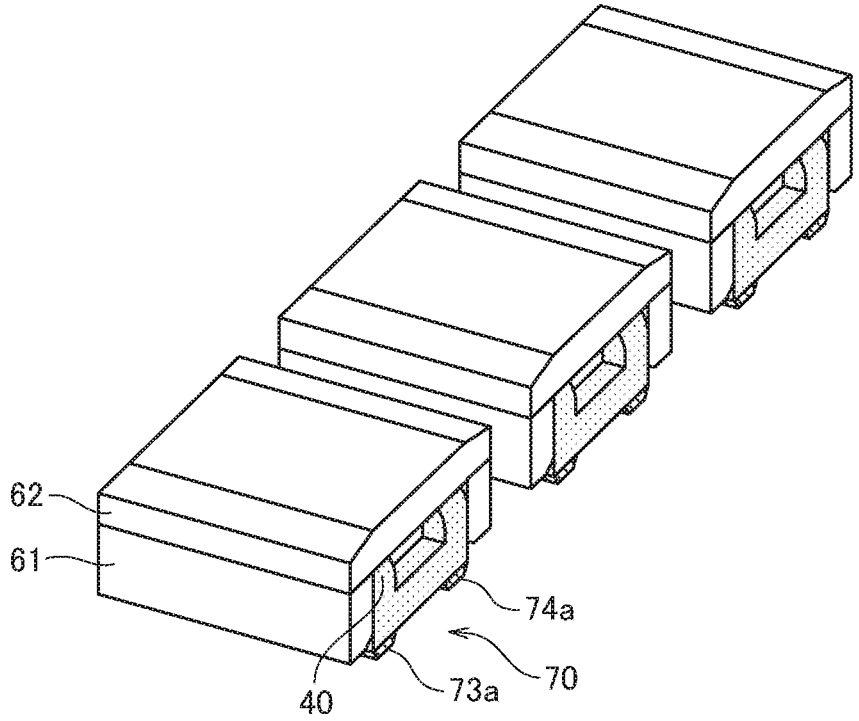

Subsequently, as illustrated in FIG. 22, the conductor plate 70 and the first core 61 are combined so that the first and second body parts 70A and 70B are housed in grooves as the through holes 60A and 60B, respectively, and then the connection part 75 and the support part 76 are separated from each other as illustrated in FIG. 23. Then, as illustrated in FIG. 24, the second core 62 is bonded to the first core 61, whereby the coil component 50 according to the present embodiment is completed.

As described above, in the present embodiment, the terminal parts 71 to 74 each have the tapered surfaces S2 in the vicinity of the tip end thereof, so that irradiation of the laser beam in the direction Z3 removes simultaneously the insulating films 40 on the tip surface S1 of each of the terminal parts 71 to 74 and the tapered surface S2 thereof. This reduces the number of processes required to remove the insulating film 40, allowing reduction in manufacturing cost.

It is apparent that the present invention is not limited to the above embodiments, but may be modified and changed without departing from the scope and spirit of the invention.

For example, in the above-described manufacturing processes, a part of the insulating film 40 is removed (see FIG. 6) after formation thereof on the entire surface of the metal element body 30S (see FIG. 5); however, the present invention is not limited to this, and the insulating film 40 may be electrodeposited with a predetermined portion of each of the first to third terminal parts 31 to 33 covered with a mask member. In this case, although the process of masking the metal element body 30S is additionally required, the process of partially removing the insulating film 40 can be omitted.

Further, in the above-described coil component 10, the conductor plate 30 is bent in a substantially U-shape in a plan view; however, the shape of the conductor plate is not limited to this in the present invention. Thus, like the coil component 10A as illustrated in FIG. 25, the conductor plate 30 may be formed into a linear shape in a plan view.

Figure 25:
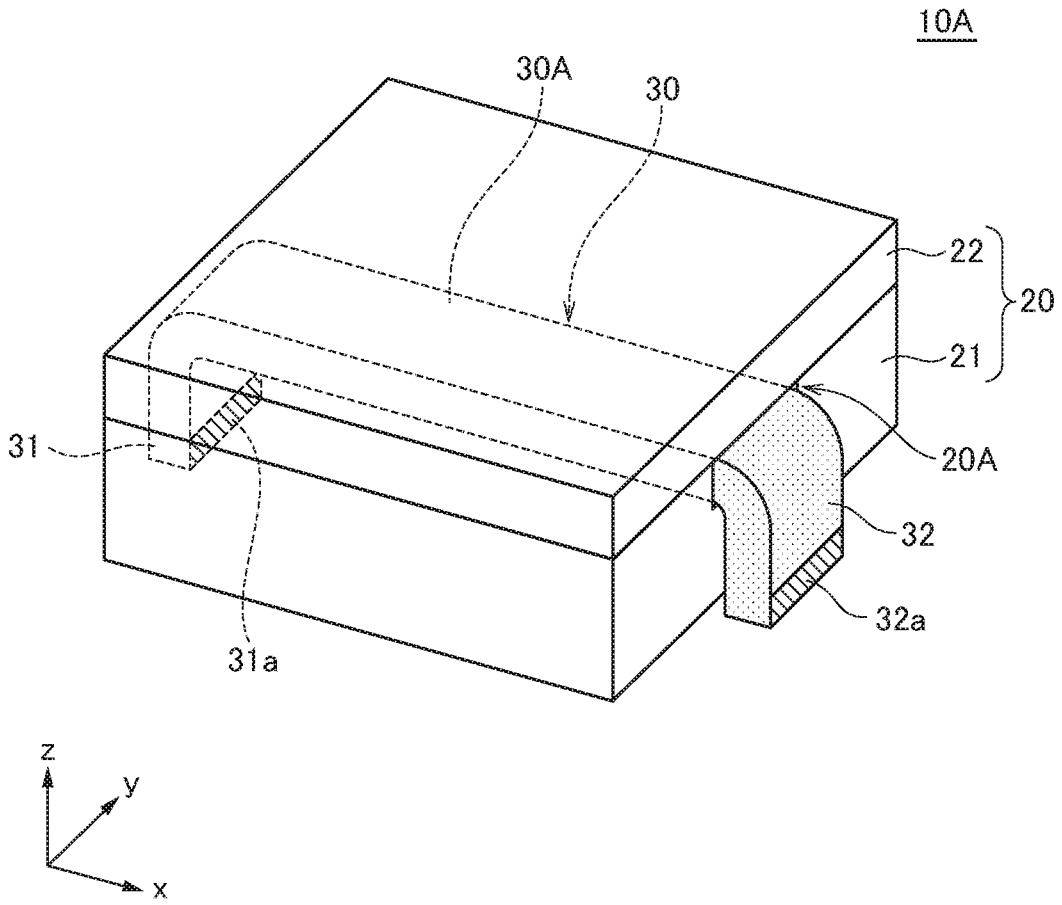
FIG. 25 is a schematic perspective view transparently illustrating the structure of a coil component according to a first modification.

A coil component 25A illustrated in FIG. 25 includes a magnetic core 20 having one through hole 20A extending in the x-direction and a conductor plate 30 inserted into the through hole 20A. The conductor plate 30 includes a body part 30A positioned inside the through hole 20A and first and second terminal parts 31 and 32 formed by bending both end portions of the body part 30A and positioned outside the through hole 20A. As in the above embodiment, the entire surface of the body part 30A and a part of each of the first and second terminal parts 31 and 32 are covered with the insulating film 40, and the vicinities of the tip end portions of the respective first and second terminal parts 31 and 32 are covered respectively with the metal films 31*a* and 32*a*. The thus configured coil component 10A can be used as a so-called ferrite bead, which is also included in the scope of the present invention.

Figure 26:
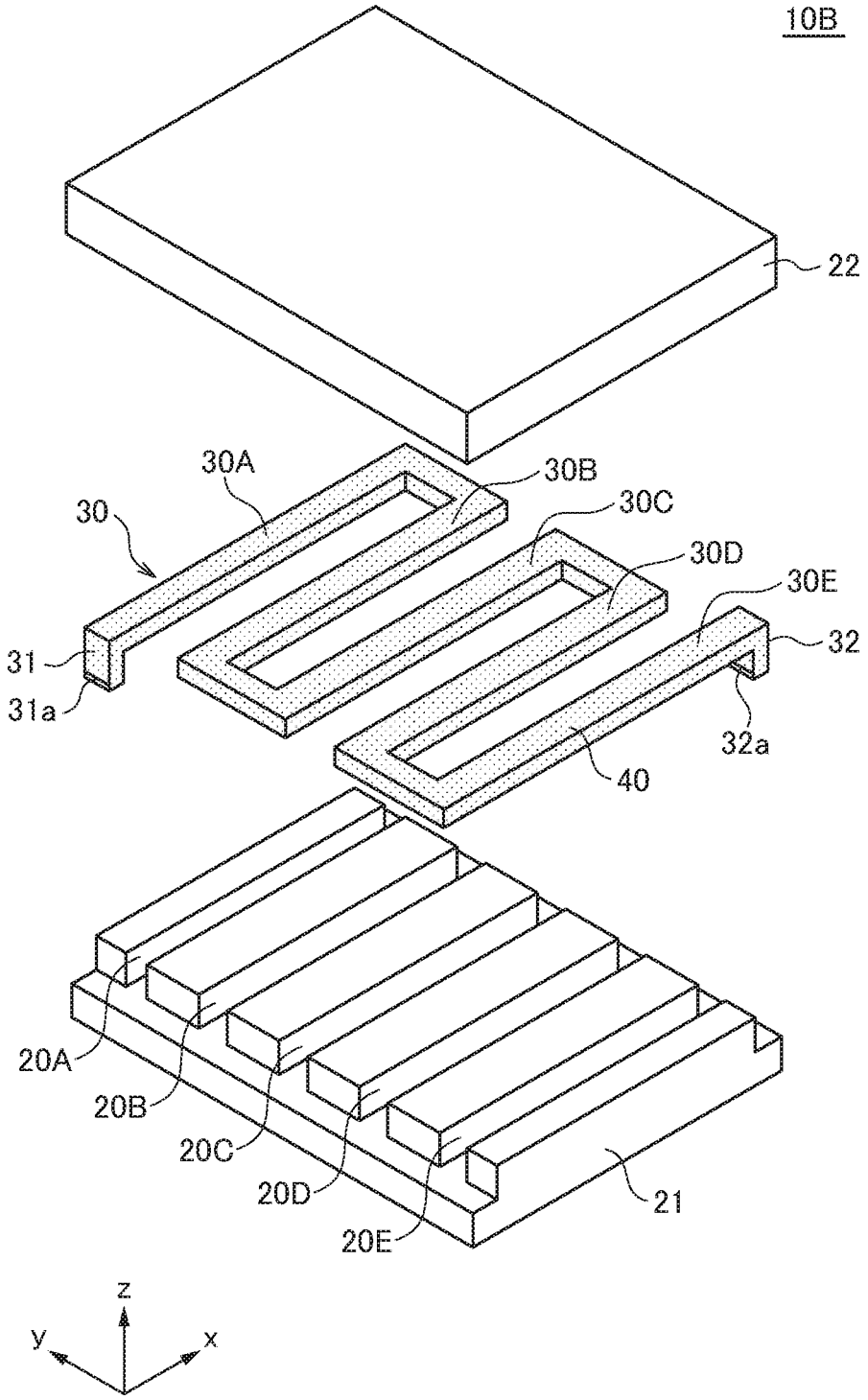
FIG. 26 is an exploded perspective view illustrating the structure of a coil component according to a second modification.

Further, like a coil component 10B illustrated in FIG. 26, the conductor plate 30 may be folded a plurality of times in a meander pattern. In the example of FIG. 26, the conductor plate 30 has five body parts 30A to 30E which are housed respectively in five through holes 20A to 20E formed in the magnetic core 20. As in the above embodiment, the entire surface of each of the body parts 30A to 30E and a part of each of the first and second terminal parts 31 and 32 are covered with the insulating film 40, and the vicinities of the tip end portions of the respective first and second terminal parts 31 and 32 are covered respectively with the metal films 31*a* and 32*a*. The thus configured coil component 10B can provide higher inductance than the coil component 10 according to the above embodiment.

Figure 27:
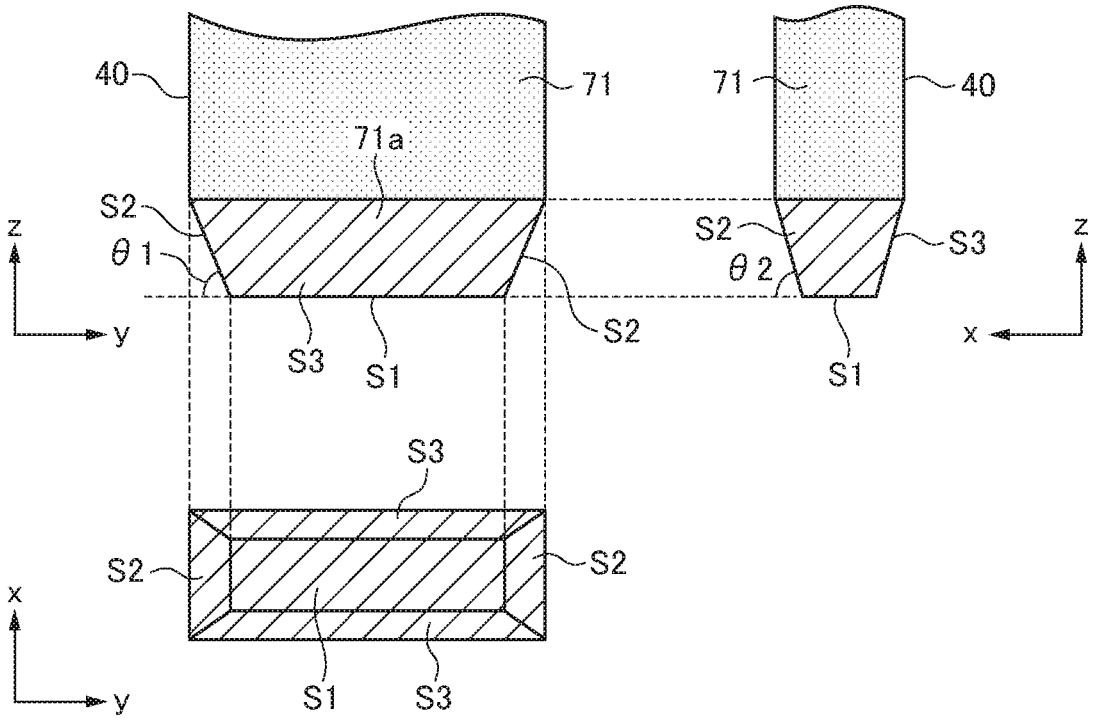
FIG. 27 is a diagram for explaining the structure of the first terminal part according to a modification.

Further, in the second embodiment, the side surfaces S3 of each of the terminal parts 71 to 74 constitute the yz plane; however, as illustrated in FIG. 27, they may be tapered by an angle θ2 with respect to the tip surface S1. With this configuration, not only the tapered surfaces S2, but also the side surfaces S3 are exposed in the z-direction, so that irradiation of the laser beam in the z-direction illustrated in FIG. 20 can remove simultaneously the insulating films 40 formed respectively on the tip surface S1, tapered surfaces S2, and side surfaces S3.

What is claimed is:

1. A coil component comprising:

a conductor plate; and a magnetic core comprising a magnetic material having electrical conductivity, wherein the magnetic core includes:

a lower surface extending in a first direction and a second direction perpendicular to the first direction;

first and second through holes extending in the first direction and arranged in the second direction;

a first side surface extending in the second direction and a third direction perpendicular to the first and second directions, wherein the first surface includes first, second, and third side surface parts;

first and second cut parts formed on the first side surface, extending in the third direction and arranged in the second direction, wherein the first cut part is positioned between the first and second side surface parts in the second direction such that one end of the first cut part is connected to one end of the first through hole and other end of the first cut part is opened to the lower surface, and wherein the second cut part is positioned between the first and third side surface parts in the second direction such that one end of the second cut part is connected to one end of the second through hole and other end of the second cut part is opened to the lower surface; and a second side surface extending in the second and third directions, wherein the second surface includes fourth and fifth side surface parts; and a third cut part formed on the second side surface, wherein the third cut part is positioned between the fourth and fifth side surface parts in the second direction such that one end of the third cut part is connected to other ends of the first and second through holes and other end of the third cut part is opened to the lower surface, wherein the conductor plate includes:

a metal element body having a first body part positioned inside the first through hole, a second body part positioned inside the second through hole, a first terminal part positioned at one end side of the first body part and positioned inside the first cut part, a second terminal part positioned at one end side of the second body part and positioned inside the second cut part, a third terminal part positioned at other end side of the first body part and positioned inside the third cut part, a fourth terminal part positioned at other end side of the second body part and positioned inside the third cut part, and a connection part that short-circuits the third and fourth terminal parts and positioned inside the third cut part;

a first metal film formed on a part of a surface of the first terminal part;

a second metal film formed on a part of a surface of the second terminal part;

a third metal film formed on a part of a surface of the third terminal part;

a fourth metal film formed on a part of a surface of the fourth terminal part; and an insulating film formed on a surface of the first and second body parts body parts and remaining parts of the surfaces of the first, second, third and fourth terminal parts, wherein the first, second, third, and fourth metal films comprise a metal material having a lower melting point than the metal element body, wherein the first metal film is exposed from the first cut part without covering the lower surface, wherein the second metal film is exposed from the second cut part without covering the lower surface, and wherein the third and fourth metal films are exposed from the third cut part without covering the lower surface.

2. The coil component as claimed in claim 1, wherein the metal element body is bent at a boundary between the first body part and the first and third terminal parts, and wherein the metal element body is bent at a boundary between the second body part and the second and fourth terminal parts.

3. The coil component as claimed in claim 1, wherein the magnetic core includes a first core constituting the lower surface and a part of an inner wall of the first and second through holes and a second core constituting a remaining part of the inner wall of the first and second through holes, and wherein a magnetic gap is formed between the first and second cores.

4. The coil component as claimed in claim 1, wherein the third and fourth terminal parts protrude from the connection part.

5. The coil component as claimed in claim 1, wherein a surface of the connection part is covered with the insulating film.

6. The coil component as claimed in claim 1, wherein a distance between the third and fourth terminal parts is substantially equal to a distance between the first and second terminal parts.

7. The coil component as claimed in claim 1, wherein each of the first to fourth terminal parts has a tapered shape in which a sectional area is reduced toward a tip end.

8. The coil component as claim 1, wherein each of the first to third cut parts has a tapered shape in which an opening area is increased toward tip ends of the first to fourth terminal parts.

9. A coil component comprising:

a magnetic core including:

an upper surface extending in a first direction and a second direction perpendicular to the first direction, wherein the upper surface includes first, second, and third upper surface parts;

first and second grooves formed on the upper surface, extending in the first direction and arranged in the second direction, wherein the first groove is positioned between the first and second upper surface parts in the second direction, and wherein the second groove is positioned between the first and third upper surface parts in the second direction;

a first side surface extending in the second direction and a third direction perpendicular to the first and second directions, wherein the first surface includes first, second, and third side surface parts;

third and fourth grooves formed on the first side surface, extending in the third direction and arranged in the second direction, wherein the third groove is positioned between the first and second side surface parts in the second direction, and wherein the fourth groove is positioned between the first and third side surface parts in the second direction;

a second side surface extending in the second and third directions and positioned on an opposite side to the first side surface, wherein the second surface includes fourth and fifth side surface parts;

a fifth grooves formed on the second side surface, extending in the third direction and positioned between the fourth and fifth side surface parts in the second direction;

a bottom surface extending in the first and second directions and positioned on an opposite side to the upper surface; and a conductive plate including first, second, third, fourth, and fifth sections inserted respectively into the first, second, third, fourth, and fifth grooves, wherein the third section is connected to one end of the first section, wherein the fourth section is connected to one end of the second section, and wherein the fifth section is connected in common to other ends of the first and second sections, wherein the conductive plate further includes first, second, third, and fourth terminal parts protruding from the bottom surface of the magnetic core and covered with a metal film, wherein the first terminal part is connected to the third section, wherein the second terminal part is connected to the fourth section, wherein the third and fourth terminal parts are connected to the fifth section, and wherein the metal film comprises a metal material having a lower melting point than the conductive plate.

* * * * *